US007284373B1

(12) United States Patent
Benson

(10) Patent No.: US 7,284,373 B1
(45) Date of Patent: Oct. 23, 2007

(54) THERMODYNAMIC CYCLE ENGINE WITH BI-DIRECTIONAL REGENERATORS AND ELLIPTICAL GEAR TRAIN AND METHOD THEREOF

(76) Inventor: Mark Christopher Benson, 13337 Mt. Pleasant Rd., Jacksonville, FL (US) 32225

( * ) Notice: Subject to any disclaimer, the term of this patent is extended or adjusted under 35 U.S.C. 154(b) by 445 days.

(21) Appl. No.: 11/036,410

(22) Filed: Jan. 14, 2005

Related U.S. Application Data

(60) Provisional application No. 60/537,056, filed on Jan. 16, 2004.

(51) Int. Cl.
*F01B 29/10* (2006.01)

(52) U.S. Cl. ..... 60/524; 60/526

(58) Field of Classification Search ..... 60/517, 60/521, 524, 516
See application file for complete search history.

(56) References Cited

U.S. PATENT DOCUMENTS

| | | | | |
|---|---|---|---|---|
| 3,730,654 | A | 5/1973 | McMahon | |
| 3,830,059 | A * | 8/1974 | Spriggs | 60/520 |
| 3,909,162 | A | 9/1975 | Nutku | |
| 3,985,110 | A | 10/1976 | Doundoulakis | |
| 4,010,716 | A | 3/1977 | Minka | |
| 4,183,214 | A | 1/1980 | Beale et al. | |
| 4,392,351 | A | 7/1983 | Doundoulakis | |
| 4,691,515 | A | 9/1987 | Ehrig et al. | |
| 4,753,073 | A | 6/1988 | Chandler | |
| 4,901,694 | A | 2/1990 | Sakita | |
| 4,926,639 | A | 5/1990 | Mitchell et al. | |
| 5,115,157 | A | 5/1992 | Blumenau | |
| 5,335,497 | A | 8/1994 | Macomber | |
| 5,381,766 | A * | 1/1995 | Sakita | 123/245 |
| 5,622,149 | A | 4/1997 | Wittry | |
| 6,195,992 | B1 | 3/2001 | Nommensen | |
| 6,205,791 | B1 * | 3/2001 | Smith, Jr. | 62/6 |
| 6,457,452 | B1 * | 10/2002 | Sakita | 123/245 |
| 6,513,326 | B1 | 2/2003 | Maceda et al. | |

* cited by examiner

*Primary Examiner*—Hoang Nguyen
(74) *Attorney, Agent, or Firm*—Simpson & Simpson, PLLC

(57) ABSTRACT

A thermodynamic cycle heat engine comprising a regenerator housing with two bi-directional regenerators, compression and expansion chambers connected to different ends of the housing, and a gear train. Each of the bi-directional regenerators comprises a low pressure connection having a first volume and a high pressure connection having a second volume less than the first volume. The bi-directional regenerators, the compression chamber, and the expansion chamber form a closed space for a working fluid. The gear train is disposed within the regenerator housing and comprises a plurality of non-round gears, a center gear group, and two outer gear groups substantially opposed with respect to the center gear group. The gear train oscillatingly rotates rotors in the chambers to create cyclically varying volumes for compression and expansion spaces so that two thermodynamic cycles are completed by the engine for each rotation of the rotors.

23 Claims, 27 Drawing Sheets

THERMODYNAMIC CYCLE ENGINE WITH BI-DIRECTIONAL REGENERATORS AND ELLIPTICAL GEAR TRAIN AND METHOD THEREOF

CROSS-REFERENCE TO RELATED APPLICATIONS

This application claims the benefit under 35 U.S.C. §119 (e) of U.S. Provisional Application No. 60/537,056, filed Jan. 16, 2004.

FIELD OF THE INVENTION

The present invention relates generally to thermodynamic cycle heat engines. In particular, the present invention is an apparatus and method for a Stirling engine with bi-directional regenerators and a gear train using opposing elliptical gear groups.

BACKGROUND OF THE INVENTION

Thermodynamic cycle heat engines (hereinafter referred to as engines or heat engines) apply the principles of heat regeneration and thermodynamic cycles to provide the power for the engine. These engines can be adapted to implement a number of thermodynamic cycles including the Stirling cycle. An engine employing the Stirling cycle (hereinafter referred to as a Stirling engine) includes a high temperature or expansion chamber and a low temperature or compression chamber. To increase efficiency, a regenerator also is added. A working fluid expands in the hot chamber, due to heat applied to the chamber, and force is applied to a piston in the chamber by the expanding fluid. The heated fluid is forced from the high temperature chamber to the low temperature chamber through the regenerator, which absorbs portions of the heat contained in the working fluid. The cooled fluid, which can be further cooled in a heat exchanger, is returned to the high temperature chamber through the regenerator. The cooled fluid absorbs heat from the regenerator. The working fluid is then reheated to repeat the cycle.

A multi-cylinder Stirling engine (MSE) is described in U.S. Pat. No. 4,392,351. The MSE includes a bi-directional regenerator and a Stirling engine as described in U.S. Pat. No. 3,985,110. Unfortunately, the two paths through the regenerator have essentially the same volume and cross-sectional configuration as shown in FIG. 3. However, the optimal volume and configuration for these paths are quite different. For the fluid from the high temperature chamber to the low temperature chamber, a slower velocity is optimal to enable greater heat transfer. Also, it is beneficial to minimize compression of the fluid in the regenerator. Thus, a large volume is desired for the path. Also, fins and other protuberances that slow fluid velocity are desirable. However, for the fluid from the low temperature chamber to the high temperature chamber, the optimal conditions are nearly opposite. That is, it is advantageous to minimize the volume of the path to increase the pressure of the working fluid as it moves through the path, which increases the overall efficiency of the engine. Further, the regenerator for the MSE is external to the Stirling engine, requiring extra space, piping, and fittings.

The MSE also uses a pair of fixed and movable plates to control the phasing of the thermodynamic cycles. Unfortunately, these plates add to the size, weight, complexity, and cost of the engine. Further, the plates limit the surface area of the low and high temperature chambers that is in contact with the heat and cold sources necessary to motivate the Stirling cycle. For example, the ends of the chambers are essentially blocked by the respective plates. To make up for this loss of heat transfer capability, heat exchangers are used. Unfortunately, the exchangers decrease the efficiency and increase the size, complexity, and cost of the MSE.

The MSE attaches rotor lobes to exterior walls of chambers and rotates the chambers to affect movement of the attached rotors. Unfortunately, the rotation of the chambers further limits the direct exposure of the chambers to the cold and heat sources needed to power the Stirling cycle and can lead to seal problems.

A rotary Stirling engine (RSE) is described in U.S. Pat. No. 5,335,497. The efficiency of a heat engine is directly related to the change in pressure for the working fluid during the thermodynamic cycle. Unfortunately, the RSE does not isolate the hot and cold chambers. Thus, the compression of the working fluid occurs in the heat exchangers as well as the chambers, which decreases the efficiency of the engine. Also, the heat transfer between the working fluid and the heat exchangers is limited, since the working fluid is not allowed to remain at rest in the exchangers during the cycles. Further, the external heat exchangers and associated piping add to the size, complexity, and cost of the engine. Also, no more than two volumes can be created in each chamber, limiting the number of thermodynamic cycles that can be completed by one revolution of the rotors in the chambers.

A rotary engine (RE) using separate compressor and combustion chambers is described in U.S. Pat. No. 4,901,694. Each chamber includes a single rotor with two lobes. Unfortunately, using only one rotor per chamber limits the number of cycles that can be completed per rotation of the rotors. The gear train for the RE also is complex. For example, to move each rotor through one cycle per rotation, a sequence of four elliptical gears is used. Further, the gear train is one-sided, which results in vibration problems.

What is needed is a thermodynamic cycle heat engine with isolated compression, transfer, and expansion cycles and optimized regeneration of the working fluid. Further, a means for increasing the number of thermodynamic cycles associated with each revolution of rotors in the chambers and an efficient gear train for controlling the rotors and cycles are needed. Also, it would be desirable to reduce the complexity of the engine and enable a greater exposure of the high temperature chamber and low temperature chambers to the respective thermal sources.

BRIEF SUMMARY OF THE INVENTION

The invention broadly comprises a thermodynamic cycle heat engine including a regenerator housing with first and second bi-directional regenerators, a compression chamber connected to a first end of the regenerator housing, and an expansion chamber connected to a second end of the regenerator housing. Each of the first and second bi-directional regenerators comprises a low pressure connection having a first volume and a high pressure connection having a second volume less than the first volume. The compression chamber is in fluid communication with the expansion chamber via the first and second bi-directional regenerators. The first and second bi-directional regenerators, the compression chamber, and the expansion chamber form a closed space for a working fluid.

First and second compression rotors are disposed within the compression chamber, the rotors forming at least one pair of compression spaces within the compression chamber.

First and second expansion rotors are disposed within the expansion chamber, the rotors forming at least one pair of expansion spaces within the expansion chamber. The engine also includes a gear train disposed within the regenerator housing and comprises a plurality of non-round gears, a center gear group, first and second outer gear groups substantially opposed with respect to the center gear group, and a power shaft. The gear train is connected to the first and second compression and expansion rotors, is arranged to oscillatingly rotate the first and second compression rotors and the first and second expansion rotors to create cyclically varying volumes for the at least one pair of compression and expansion spaces, respectively. The gear train also controls the fluid communication between the compression and expansion chambers so that two thermodynamic cycles are completed by the engine for each rotation of the first and second compression and expansion rotors.

The present invention also includes a method for completing a thermodynamic cycle in a heat engine.

It is a general object of the present invention to provide an apparatus and method for isolating compression, transfer, and expansion cycles in a heat engine.

It is another object of the present invention to provide an apparatus and method for optimizing regeneration of the working fluid in a heat engine.

It is still another object of the present invention to provide an apparatus and method for increasing the number of thermodynamic cycles associated with each revolution of rotors in the chambers of a heat engine.

It is a further object of the present invention to provide an apparatus and method for increasing the efficiency of the gear train for controlling the rotors and cycles in a heat engine and minimizing vibrations associated with the gear train.

It is still a further object of the present invention to provide an apparatus and method for reducing the complexity of a heat engine and enabling a greater exposure of the high temperature chamber and low temperature chambers of the heat engine to the respective thermal sources.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify substantially identical structural elements of the invention. While the present invention is described with respect to what is presently considered to be the preferred embodiments, it is understood that the invention is not limited to the disclosed embodiments.

Furthermore, it is understood that this invention is not limited to the particular methodology, materials and modifications described and as such may, of course, vary. It is also understood that the terminology used herein is for the purpose of describing particular embodiments only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
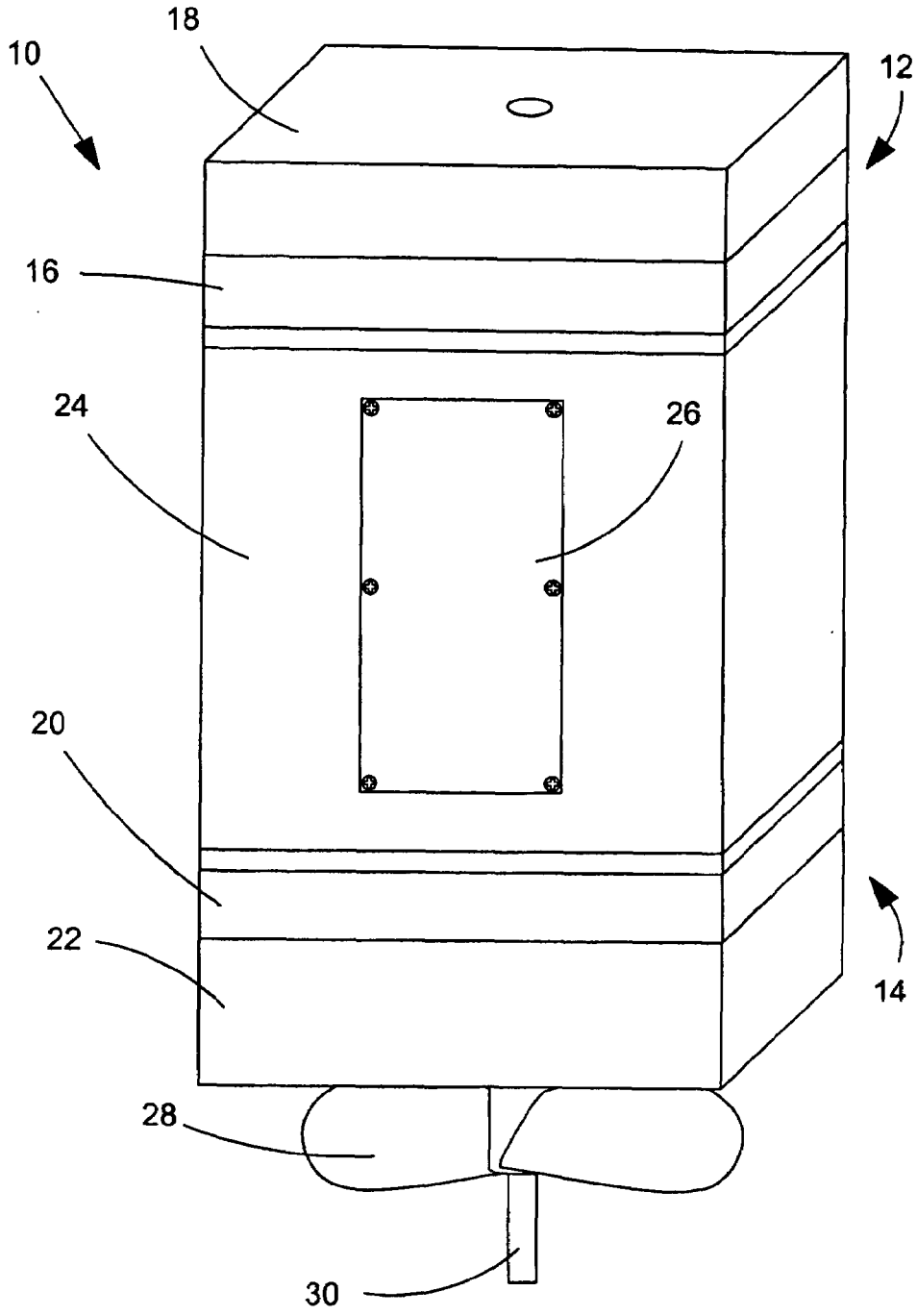
FIG. 1 is a perspective view of a present invention engine.

FIG. 1 is a perspective view of a present invention engine 10. It should be understood that engine 10 can function as an engine (provide output power) or can be used as a heat pump or cooler. Engine 10 includes expansion chamber 12 and compression chamber 14. Note that expansion chamber 12 and compression chamber 14 also can be referred to as a high temperature chamber or a low temperature chamber, respectively. Chamber 12 includes expansion plate 16 and expansion cap 18. Chamber 14 includes expansion plate 20 and expansion cap 22. As further described below, plates 16 and 20 and caps 18 and 22 form a respective volume within chambers 12 and 14. Insulator 24 covers the portion of engine 10 between the chambers. Insulator 24 can be made of any insulating material known in the art. The thickness and structural characteristics of insulator 24 can be selected as needed for any particular application. For example, if engine 10 is installed in an accessible area in which the engine could be damaged, insulator 24 can be made of a sturdy material that would resist blows or other physical intrusions. Access panel 26 covers an opening (not shown) enabling access to the portion of engine 10 between the chambers. The size and position of panel 26 can be determined according to the requirements of any particular application. Engine 10 is shown in the shape of a rectangular block. However, it should be understood that engine 10 is not restricted to any particular shape and can be configured in any geometry necessary for a particular application. For example, engine 10 can be cylindrical in shape. In some aspects, engine 10 includes fan 28 connected to shaft 30. In the embodiment shown, chamber 14 is the compression chamber, therefore, fan 28 provides useful cooling for chamber 14.

Engine 10 can approximate thermodynamic cycles including the Stirling and Ericsson cycles by adjusting the phasing and shaping gears and drive systems. Engine 10 can provide output power at a drive shaft (for example, shaft 30) or can receive power via a drive shaft to operate as a heat pump or cooler. Chambers 12 and 14 and the bidirectional regenerators described below form a closed space containing a working fluid. The working fluid may be hydrogen, helium, or any other gas or liquid known in the art. Thermodynamic cycles are performed on the working fluid as further described below.

Figure 2:
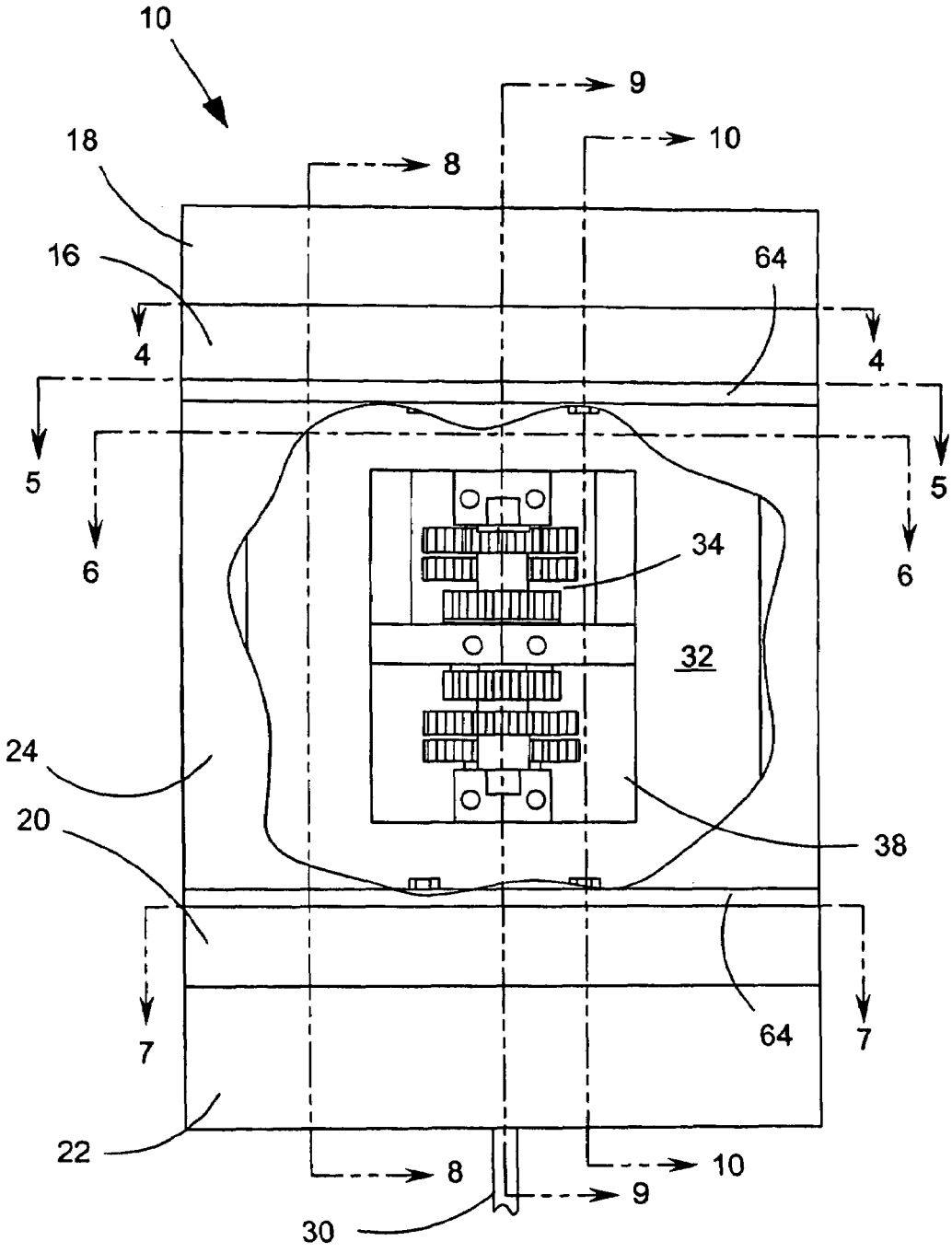
FIG. 2 is a side view of the engine of FIG. 1 with the access panel removed and the insulator partially removed.

FIG. 2 is a side view of the engine of FIG. 1 with access panel 26 removed and insulator 24 partially removed. In some aspects, housing 32 forms a compact structural foundation for engine 10, reducing the size, complexity, and cost of manufacturing engine 10. Chambers 12 and 14 are mounted on opposing sides of housing 32. Bi-directional regenerators (not shown) and gear train 34 (portions are shown) also are mounted in housing 32. This arrangement has a myriad of advantages. The drive mechanism interfaces with the chambers through the respective plates, leaving the large surface area of the caps and portions of the plate surface to contact the hot and cold reservoirs. Increasing the contact area optimizes heat exchange between the chambers and the reservoirs. Thus, extensive thermal transfer is possible without the use of heat exchangers or other ancillary equipment. The cap may be a single layer or have one layer tailored for the inside of the chamber and an outer layer to provide strength and shaped to provide the best heat exchange for the application. Chambers 12 and 14 are separated by housing 32, increasing the efficiency of the respective thermodynamic processes occurring in the chambers. Chambers 12 and 14 can be triode, 'D', or any other shape known in the art to optimize heat transfer.

Figure 3:
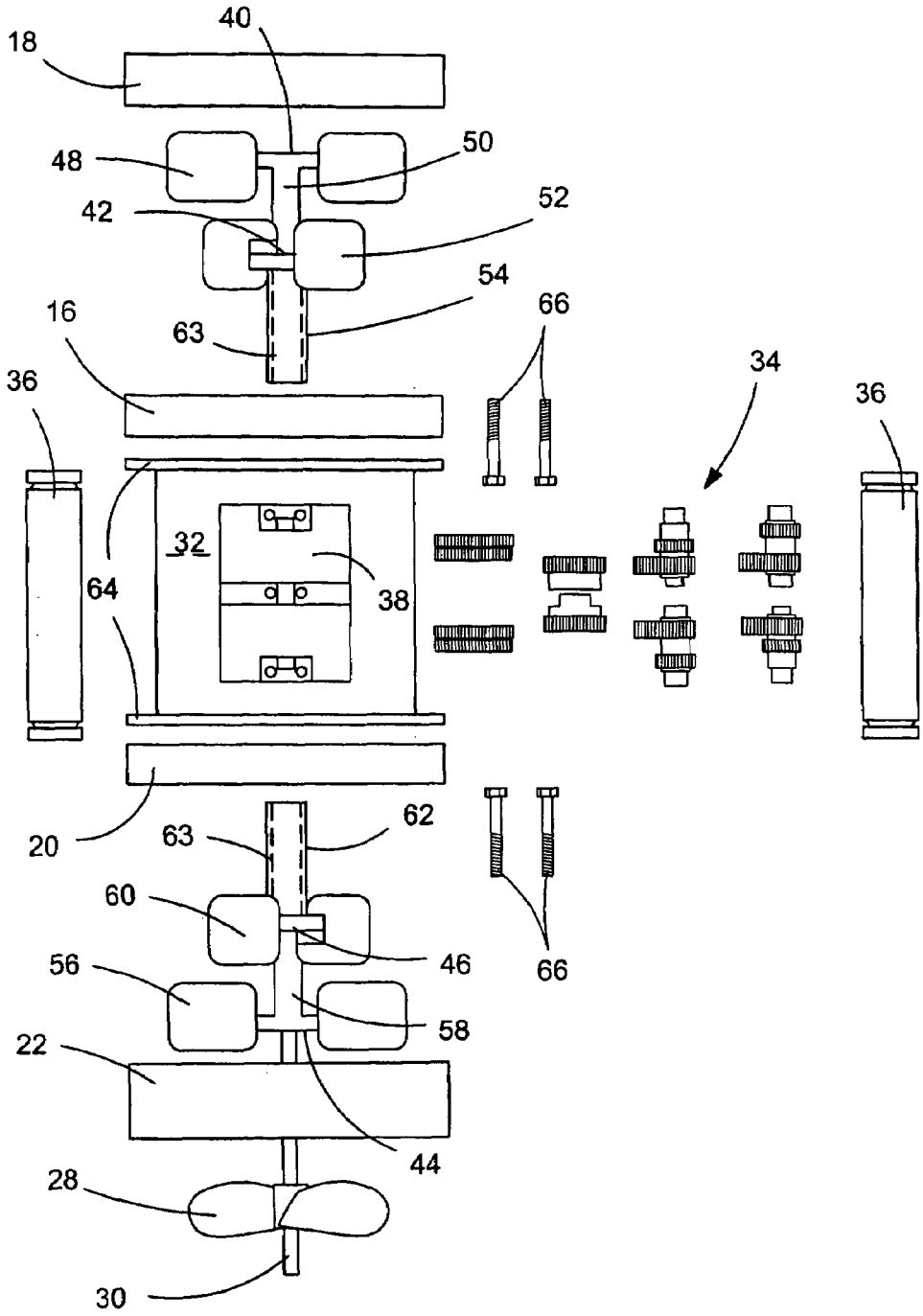
FIG. 3 is an exploded view of the engine shown in FIG. 1.

FIG. 3 is an exploded view of the engine shown in FIG. 2. To simplify the presentation, insulator 24 is not shown. Gear train 34 and bi-directional regenerators 36 are positioned in space 38 within housing 32. In FIG. 3, regenerators 36 are shown as modular units. However, it should be understood that the regenerators can be made integral to housing 32 (not shown). Plate 16 and cap 18 form a space or cavity (not shown) in which rotors 40 and 42, also referred to as expansion rotors, are located. Plate 20 and cap 22 form a space or cavity (not shown) in which rotors 44 and 46, also referred to as compression rotors, are located. The cavities are further described below. Rotor 40 includes lobes 48 and shaft 50. Rotor 42 includes lobes 52 and shaft 54. Rotor 44 includes lobes 56 and shaft 58. Rotor 46 includes lobes 60 and shaft 62. In general, each chamber includes at least two rotors and each rotor includes at least one lobe. However, engine 10 is not limited to any particular number of rotors per chamber or lobes per rotor. In general, for the rotors in a particular chamber, the number of lobes and the shape of the lobes match. In some aspects, rotors 40 and 42 and 44 and 46 are interlaced. Shafts 54 and 62 include openings 63 parallel to a longitudinal axis (not shown) for each shaft and shafts 50 and 58, respectively, pass through openings 63 and rotate within openings 63. In general, a fluid-tight seal is maintained between the interlaced portions of rotors 40 and 42 and 44 and 46 using any means known in the art.

Plates 16 and 20 can be mounted to housing 32 using any means known in the art. In some aspects, housing 32 includes flanges 64, used for mounting plates 16 and 20. Any means known in the art can be used to mount the plates to the flanges. For example, holes (not shown) can be formed in the flanges to pass bolts 66 that thread into the respective plate. In general, the seal between the flanges and plates should be substantially fluid-tight. Thus, it should be understood that any additional means known in the art for ensuring a fluid-tight seal (not shown) can be used. These sealing means could include rings, gaskets, or sealing compounds.

Figure 4:
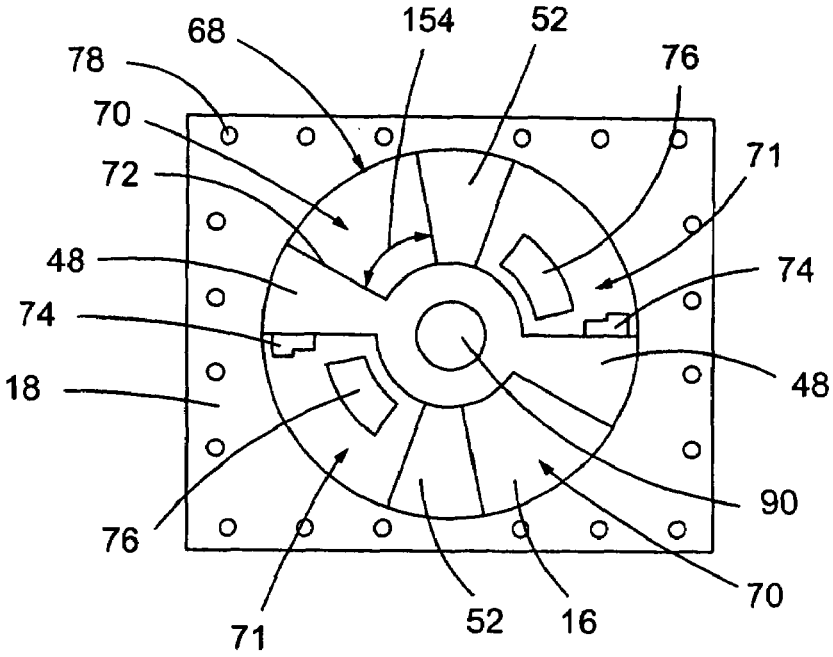
FIG. 4 is a cross-sectional view of the engine shown in FIG. 2 along lines 4-4.

FIG. 4 is a cross-sectional view of the engine shown in FIG. 2 along lines 4-4. The following should be viewed in light of FIGS. 3 and 4. As noted above, cap 18 is configured to form, with plate 16, a volume within chamber 12. In FIG. 4, this volume is shown as a radial cross-section of cavity 68. In general, the radial cross-sections of the chambers (as shown in FIG. 4) for engine 10 are circular to accommodate the rotation of the respective rotors within the chambers. Rotors 40 and 42 are positioned within cavity 68. In general, a pair of volumes or spaces is formed by each pair of lobes in a chamber. Therefore, at least one pair of spaces is formed in each chamber by the respective lobes in the chamber. Lobes 48 and 52 are interleaved to form two pairs of volumes or spaces 70 and 71, also called expansion spaces, within cavity 68. In general, respective rotors and chamber cavities are closely matched in shape. For example, the rotor shafts 50 and 54 fill a central portion of cavity 68, leaving a toroidal space through which lobes 48 and 52 rotate. Spaces 70 and 71 are formed within the toroidal space. Seals (not shown) are provided at the edges of the lobes, for example edge 72 of lobe 48 such that the spaces 70 and 71 are substantially fluidly isolated from each other. Any means known in the art can be used to seal the lobe edges. As further described below, rotors 40 and 42 rotate in the same direction around shafts 50 and 54, respectively, in cavity 68. Engine 10 can be configured so that rotors 40 and 42 rotate either clockwise or counterclockwise.

High pressure ports 74 in plate 16 are in fluid communication with the high pressure connections (not shown) for regenerators 36. Low pressure ports 76 in plate 16 are in fluid communication with the low pressure connections (not shown) for regenerators 36. The low pressure and high pressure connections are further described below. As rotors 40 and 42 rotate, ports 74 and 76 are cyclically covered and uncovered by lobes 48 and 52, as further described below. Cap 18 can be connected to plate 16 by any means known in the art. For example, holes 78 can be used to accommodate fasteners (not shown). It should be understood that the above description is applicable to plate 20, cap 22, and rotors 44 and 46.

Figure 5:
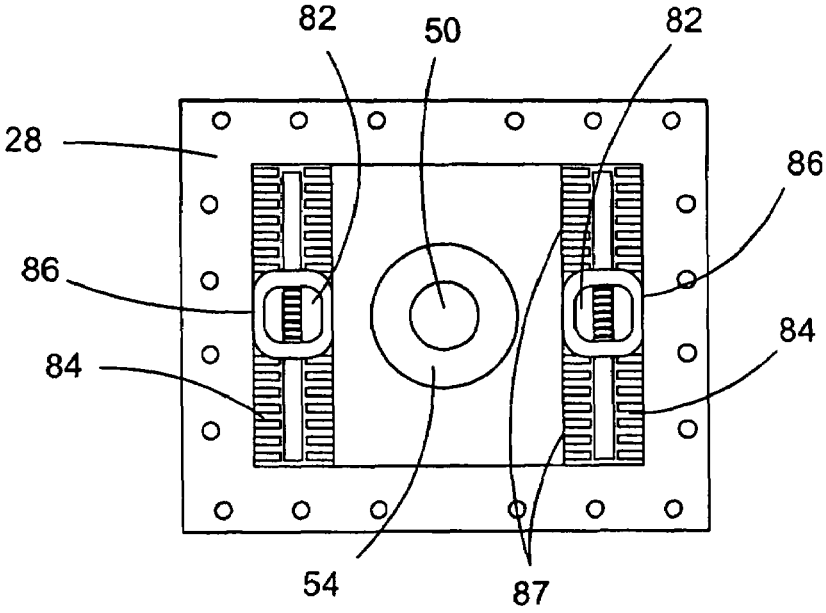
FIG. 5 is a cross-sectional view of the engine shown in FIG. 2 along lines 5-5.

FIG. 5 is a cross-sectional view of the engine shown in FIG. 2 along lines 5-5. The following should be viewed in light of FIGS. 3 through 5. Engine 10 advantageously separates the compression and expansion cycles occurring within the engine. This is partially accomplished by using separate chambers 12 and 14 and by isolating the low pressure and high pressure paths in regenerators 36. Thus, each regenerator 36 includes a high pressure passage or connection 82 and a low pressure passage or connection 84. These connections are separate from each other and are used during different parts of the thermodynamic cycle, as described below. In some aspects, connections 82 and 84 share at least one common wall. In FIG. 5, connection 82 shares two sidewalls with connection 84. It should be understood that connections 82 and 84 are not restricted to any particular shape or configuration. For example, fins or other protrusions can be used to increase the surface area of the connections or to control the direction or speed of the working fluid through the connection.

In some aspects, connection 82 includes a port 86, which is in fluid communication with chambers 12 and 14 as described below. Connection 84 typically has a larger input/output area. For example, in some aspects, the entire top cross-section 87 of connection 84, with the exception of the area occupied by port 86 is open for fluid communication. In some aspects, each port 74 is directly connected to a separate port 86 in a respective regenerator 36 and each port 86 in engine 10 is separate from the remaining ports 86. In some aspects, each port 76 is in fluid communication with a connection 84 for a respective regenerator 36. That is, there is a one-to-one correspondence between the ports in chamber 12 and 14 and connections 82 and 84. In some aspects, for example, as shown in FIG. 5, both ports 76 for chamber 12 or 14 are in fluid communication with both regenerators 36. That is, both connections 84 in FIG. 5 are in fluid communication.

The volumes of connections 82 and 84 are selected to increase the efficiency of engine 10. In general, the efficiency of engine 10 is directly related to the changes in the volumes of the working fluid taking place within the compression and expansion spaces. Alternately stated, minimizing the energy needed to complete the compression and expansion phases increases the amount of useful work the engine can output or perform. Thus, as the working fluid moves from chamber 14 to chamber 12 through connection 82, it is desirable to compress the fluid. Therefore, the volume of connection 82 is minimized. As the working fluid moves from chamber 12 to chamber 14, it is desirable to avoid compressing the fluid. Therefore, the volume of connection 84 is maximized. The volume of connection 84 is relatively large for at least two other reasons. First, the present invention optimizes the expansion phase by overlapping the discharge from the pairs of expansion spaces in chamber 12 to connection 84. For example, in engine 10, both pairs of expansion spaces in chamber 14 discharge fluid into connections 84 at the same time. Thus, the volume of connections 84 must be large enough to accommodate the combined volume of the expansion spaces. In those aspects in which each port 76 is connected to a separate connection 84, each connection 84 has a volume greater than the volume of the respective expansion space. Second, it is desirable to optimize heat transfer for the working fluid as it passes through connection 84. Thus, a larger volume for connection 84 results in a longer transit time for the working fluid in connections 84 as well as greater surface areas in connections 84 to which to transfer thermal energy. The cross-sectional areas of connections 82 and 84 also can be selected to optimize the performance of the connections. For example, the cross-sectional area of connections 82 is generally less than the cross-sectional area of connections 84 for the reasons noted above.

Figure 6:
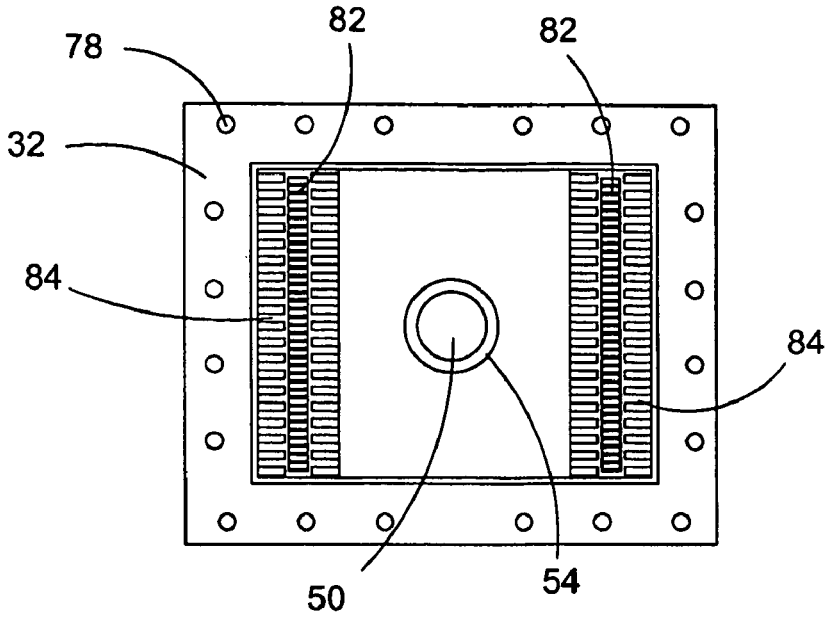
FIG. 6 is a cross-sectional view of the engine shown in FIG. 2 along lines 6-6.

FIG. 6 is a cross-sectional view of the engine shown in FIG. 2 along lines 6-6. FIG. 6 further illustrates the nesting of connection 82 within connection 84.

Figure 7:
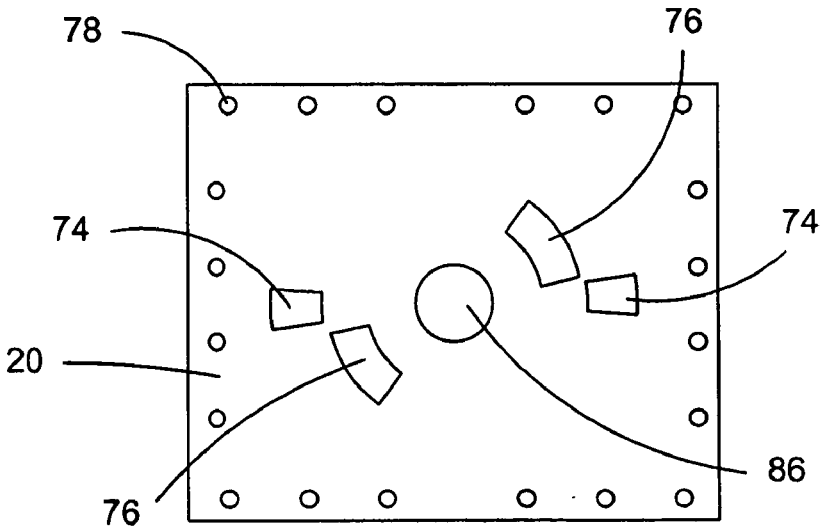
FIG. 7 is a cross-sectional view of the engine shown in FIG. 2 along lines 7-7.

FIG. 7 is a cross-sectional view of the engine shown in FIG. 2 along lines 7-7. The following should be viewed in light of FIGS. 3, 4, and 7. Plate 20 includes ports 74 and 76. Shafts 58 and 62 pass through opening 86 in plate 14 for connection to gear train 34. Note that plate 12 includes a similar opening for shafts 50 and 54.

Figure 8:
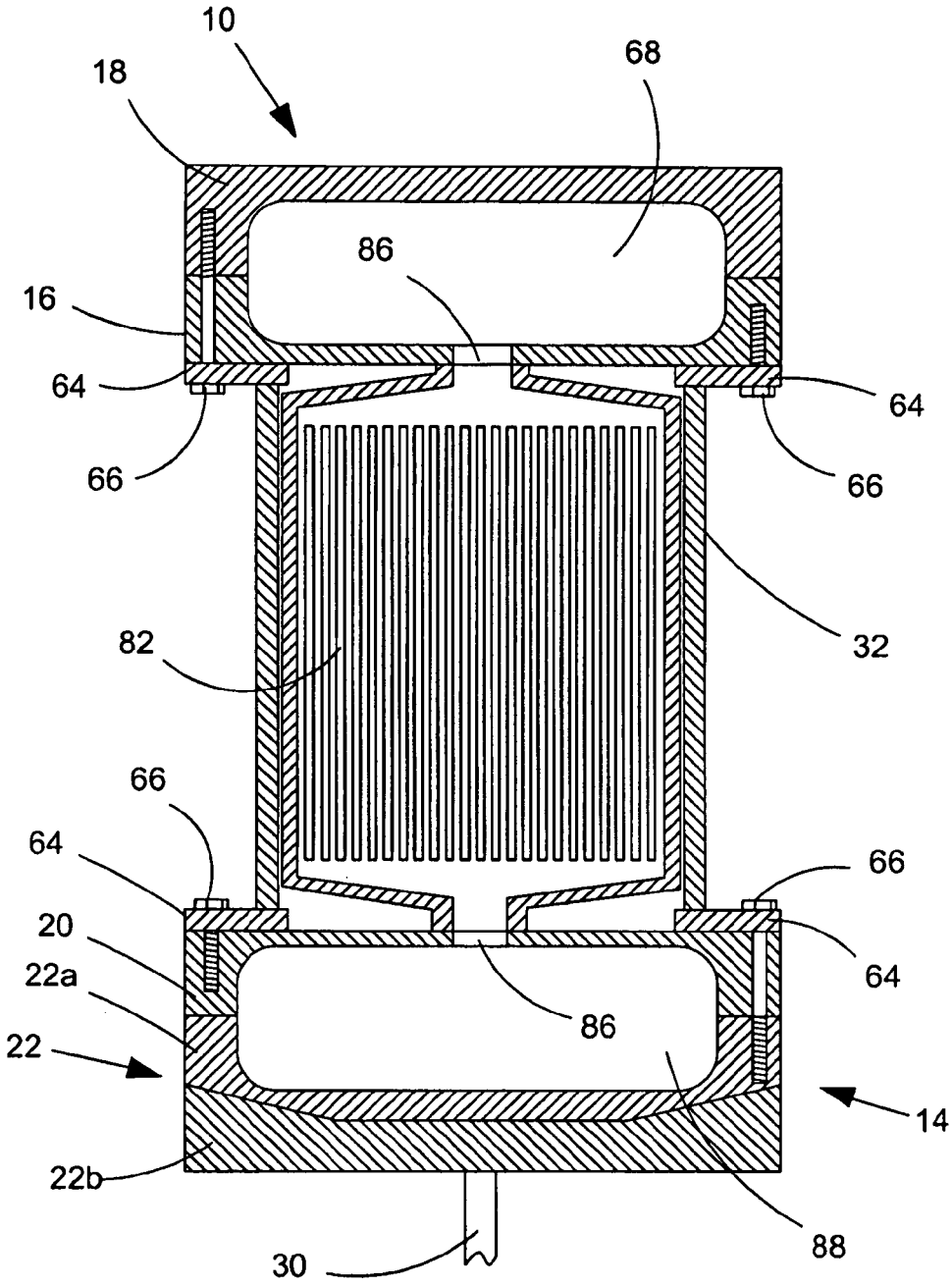
FIG. 8 is a cross-sectional view of the engine shown in FIG. 2 along lines 8-8.

FIG. 8 is a cross-sectional view of the engine shown in FIG. 2 along lines 8-8. The following should be viewed in light of FIGS. 5, 6, and 8. In FIG. 8, the rotors are not shown, to more clearly illustrate cavities 68 and 88 in chambers 12 and 14, respectively. FIG. 8 also shows further detail of connection 82. In some aspects caps 18 or 22 can be made of multiple layers or components to optimize a desired characteristic, for example, the portion in contact with the rotors can be made of durable, wear-resistant, and pressure-resistant material, while the portion in contact with the heat or cold reservoir can be made of a conductive material. In FIG. 8, cap 22 is formed of two segments. Segment 22*a* helps form cavity 88, while segment 22*b*, on the end of cap 22 can be made of a conductive material to enhance the cooling of chamber 14.

Figure 9:
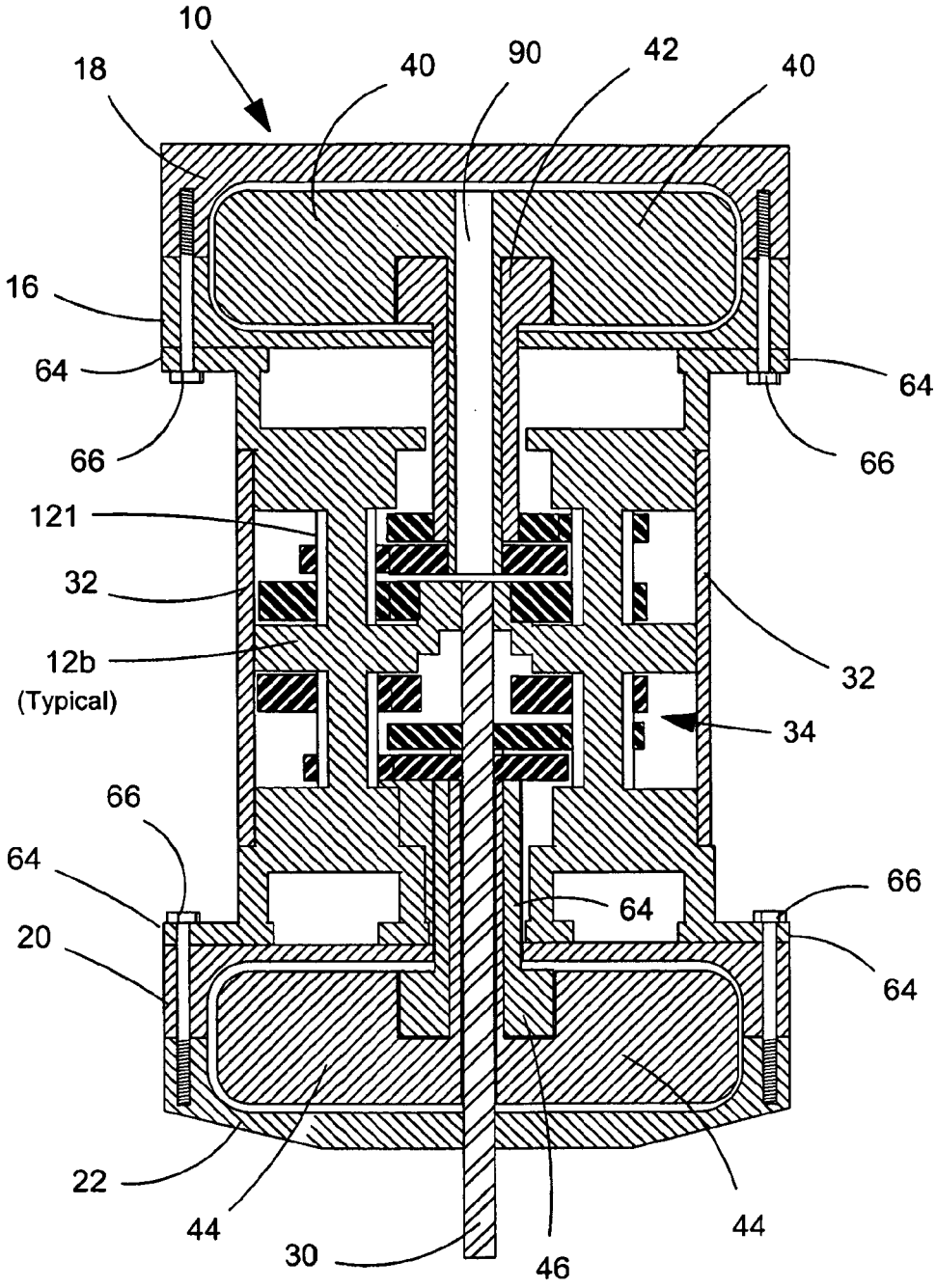
FIG. 9 is a cross-sectional view of the engine shown in FIG. 2 along lines 9-9.

FIG. 9 is a cross-sectional view of the engine shown in FIG. 2 along lines 9-9. The shapes of cavities 68 and 88 and rotors 40 and 42 and 44 and 46, respectively, are generally complimentary. It should be understood that cavities 68 and 88 and rotors 40 and 42 and 44 and 46 are not limited to any particular shape or configuration. In some aspects, the size and shape of cavity 68 and rotors 40 and 42 match the size and shape of cavity 88 and rotors 44 and 46. However, it should be understood that different sizes or shapes for cavity 68 and rotors 40 and 42 and cavity 88 and rotors 44 and 46 respectively, are possible. In some aspects, rotors 40 and 44 include opening 90 parallel to a longitudinal axis (not shown) for each shaft. In some aspects, drive shaft 30 is inserted through opening 90, for example, through opening 90 in rotor 44, to engage gear train 36.

Figure 10:
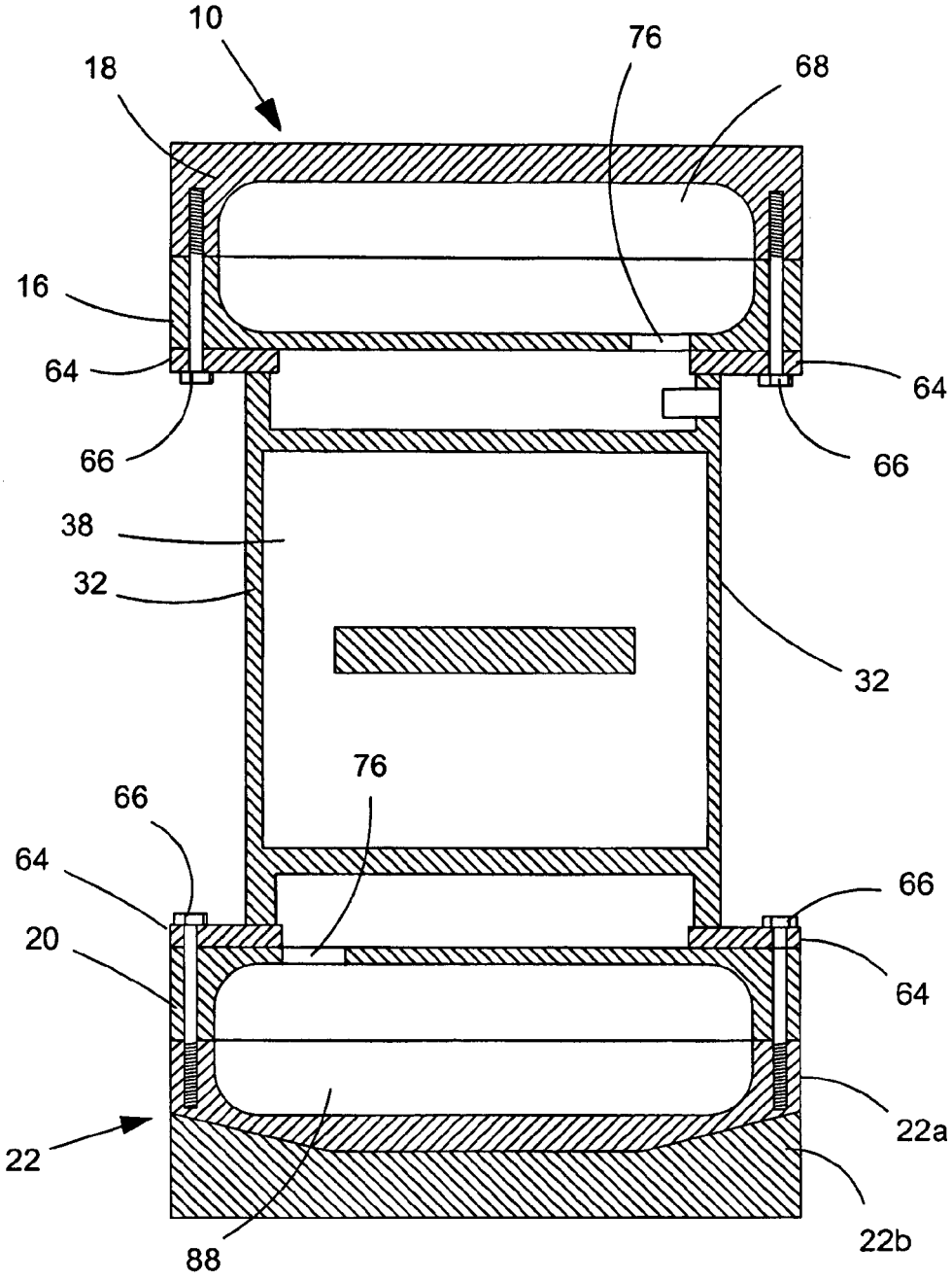
FIG. 10 is a cross-sectional view of the engine shown in FIG. 2 along lines 10-10.

FIG. 10 is a cross-sectional view of the engine shown in FIG. 2 along lines 10-10.

Figure 11:
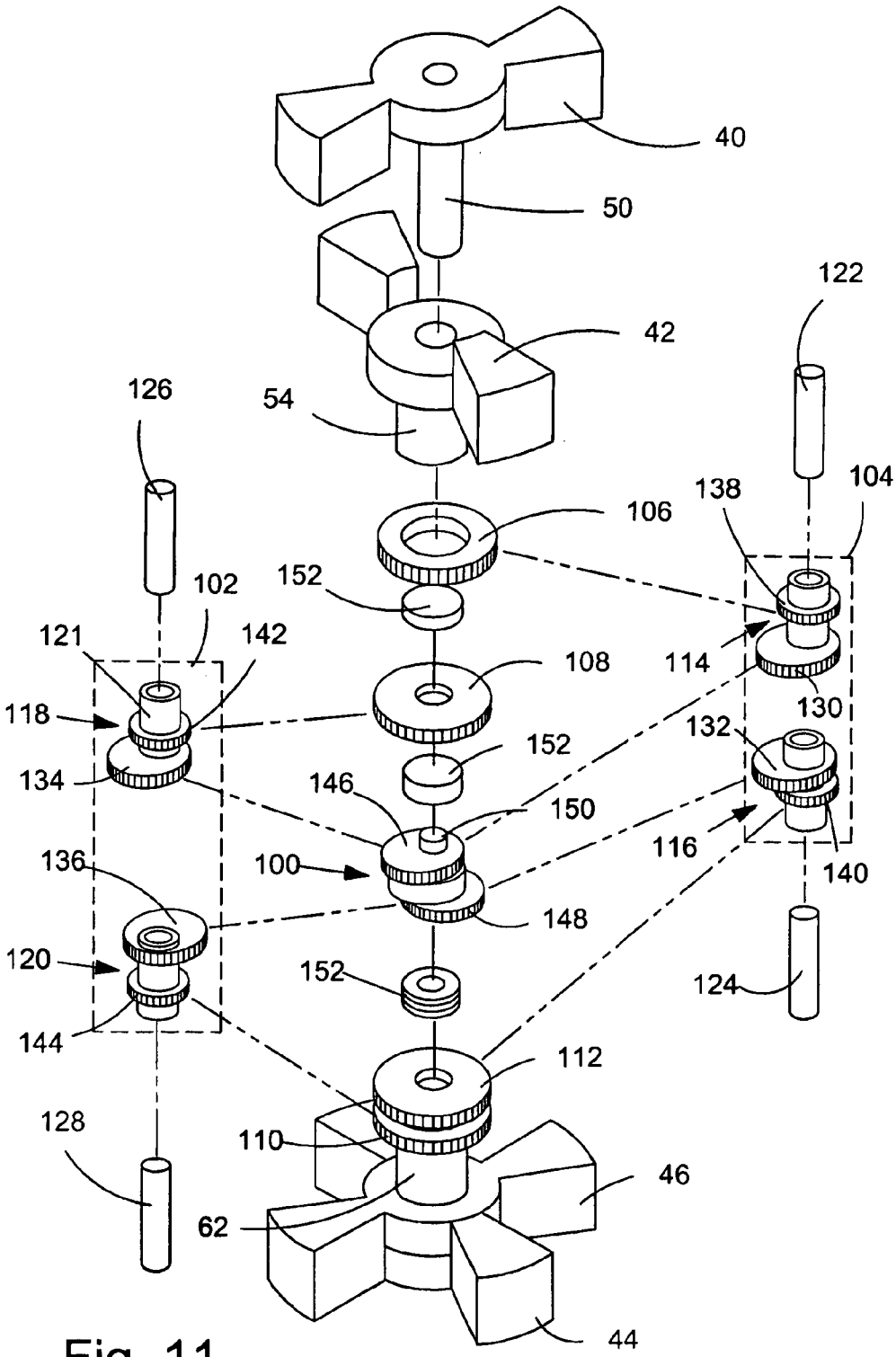
FIG. 11 is an exploded view of the gear train shown in FIG. 3.

FIG. 11 is an exploded view of the gear train shown in FIG. 3. In general, gear train 36 includes center gear group 100, outer gear group 102, and outer gear group 104. In general, gear train 36 contains a plurality of non-round gears. Non-round gears can be elliptical, oval, or any shape known in the art. For example, oval gears that produce a specific cycle per revolution ratio can be used. Standard elliptical and oval gears can be used, although specially designed gears maybe used to optimize the cycles. In general, elliptical gears have the axis at one focus and are dynamically balanced. Oval gears, which are ellipses with the axis at the center, allow the use of rotors with more than two sides. In FIG. 11, elliptical gears are used as the non-round gears. Groups 102 and 104 are opposed with respect to group 100, that is, groups 102 and 104 are symmetrically located on either side of center group 100. By positioning groups 102 and 104 in opposing positions, gear train 100 is balanced and undesirable vibrations associated with one-sided gear arrangements are eliminated. The opposed outer gear groups also enable the gear train to be compactly installed within housing 32.

Rotor round gears 106 and 108 are mounted on shafts 54 and 50, respectively. Rotor round gears 110 and 112 are mounted on shafts 62 and 58, respectively. The respective rotor round gears are used to rotate the rotors within the chambers. In some aspects, groups 102 and 104 each include two pairs of gears and in each pair one gear is non-round. In some aspects, each pair is mounted to a separate outer gear shaft. In some aspects, the mounted gears rotate about the respective outer gear shaft. Thus, pairs 114, 116, 118, and 120 are mounted to stems 121, which in turn are mounted over shafts 122, 124, 126, and 128, respectively. Stems 121 rotate about the shafts as the respective gears rotate. In the embodiment shown, pairs 114, 116, 118, and 120 include outboard elliptical gears 130, 132, 134, and 136, respectively and outboard round gears 138, 140, 142, and 144, respectively. Group 100 includes center elliptical gears 146 and 148, which are fixedly mounted to shaft 150. That is, shaft 150 rotates responsive to gears 146 and 148 and gears 146 and 148 rotate together. For drive systems that use gears to the side to drive the system (not shown), an idler gear (not shown) is placed on an outboard shaft.

Bearing packs 152 are used to hold shaft 150 in position. Housing 32 is configured to hold the bearing packs. Bearing packs 152 also provide rotating support for rotor shafts 50, 54, 58, 62. It should be understood that other arrangements known in the art can be used to support and enable rotation of the rotors and group 100 and that such arrangements are included within the spirit and scope of the claims. Spacers and any other means known in the art can be used to align the component gears in the gear train.

The following should be viewed in light of FIGS. 1 through 11. The following description is for chamber 12 and rotors 40 and 42, however, it should be understood that the description is applicable to chamber 14 and rotors 44 and 46 as well. Gear train 34 is used to produce an oscillatory rotation of rotor 40 with respect to rotor 42. As a result, cyclically varying volumes are created for spaces 70. That is, the tangential distances between lobes 48 and 52, for example, distance 154, varies. Alternately stated and as shown, gear train 34 is arranged to move lobes 48 and 52 in opposing directions to increase and decrease the volumes for spaces 70 and 71. Gear train 34 uses pairs of elliptical gears, for example gears 130 and 146 to produce oscillatory, one cycle per rotation motion. Pairs of round gears, for example, gears 106 and 138 provide the two cycles per rotation that are needed for the embodiment shown, which completes two thermodynamic cycles per revolution of the rotors.

The phasing between rotors, for example, rotors 40 and 42 is a key to creating an efficient thermodynamic cycle. The pairs of rotors shown in FIG. 3 each has a cycling rotational velocity to create the periodically varying or oscillating volume between the respective rotors by use of the elliptical gears. The phase difference between chambers 12 and 14 creates expansions and compressions of the working fluid at different times so that the working fluid is moved from one chamber, for example, chamber 12, thought regenerators 36 to the opposite chamber, for example, chamber 14, to create the thermodynamic cycle. The number of independent thermodynamic cycles for each chamber is a function of at least the number of rotors, lobes, and ports in the chambers, the number of regenerators in the engine, and the ratios in the gear train. For example, the embodiment shown has two pairs of rotors and each rotor has two lobes. Further, there are two pairs of ports in each chamber, there are two regenerators, and the gear train provides two cycles per rotor revolution. Therefore, two opposing sets of compression spaces, each of which supports an independent thermodynamic cycle, are created and each set completes two cycles per rotor revolution. Each space in an opposing set is in the same cycle and phase and as the volume for one set is expanding, the volume for the other set is contracting. Thus, complimentary phases are occurring among the sets of spaces. For example, as spaces 70 are expelling fluid to chamber 14, spaces 71 are receiving fluid from chamber 14. The embodiment shown is a paired arrangement. There is a pair of chambers (compression and expansion), a pair of regenerators 36, and a pair of outboard gear groups.

Regenerators 36 are isolated from chamber 12 and 14 during the compression and expansion phases due to the blocking action of the rotor lobes. As noted above, the efficiency of the engine is directly related to the volume changes in the working fluid during the compression and expansion phases. Thus, the present invention concentrates the available compression and expansion forces in chambers 12 and 14 on just the fluids in the chambers, creating a larger change in volume in these fluids than would be possible if the compression and expansion forces were also applied to the fluid in regenerators 36. Since chamber 12 and 14 are isolated from regenerators 36 during the compression and expansion phases, the volume of the regenerators does not need to be undesirably small to increase efficiency in the chambers. Thus, as described above, the volume of low pressure connections 84 can be made relatively large to allow both expansion chambers to simultaneously discharge into connections 84 and to enhance thermal transfer from the fluid to the wall of connections 84 without the drawback of decreasing the volume change occurring during the compression phase.

A present invention engine can be configured to rotate within a fixed base (not shown). For example, flanges 68 can be mounted to a bearing race connected to a fixed bearing race. The first bearing race is then attached to a gear or drive belt, enabling engine 10 to be rotated or to rotate within the bearing race arrangement. The drive system for the preceding arrangement can use one or more gears meshed with the rotor round gears and mounted on outboard shafts. These gears are meshed with a planetary gear surrounding the engine. Thus, as the engine rotates, the drive system rotates the elliptical gears. The gears linking the engine to the planetary gear can be stepped with additional gears to step down the ratio of engine rotation to rotor rotation. Multiple engines can be connected to a single power shaft or be powered by a single shaft (not shown). Engines also can be configured in series (not shown) to create a larger change in heat energy than would be possible using only one stage of a single engine. Engines installed in groups can be configured to counter rotate, balancing the torque effect of the group. Torque of a drive system also can be balanced with a device or the weighting of the device. In some aspects, separate gears are used for chambers 12 and 14 (not shown), enabling the phase angle between the chambers to be changed. For example, actuators can rotate planetary gears to effect the phase angle change. In some aspects (not shown), housing 32 includes an enclosed gear section to enable lubrication of gear train 34. Lubricant can be circulated for heat flow within the section and regenerators 36 can be insulated as desired. In some aspects, caps 18 or 22 can include flow tubes (not shown) to enhance heating or cooling in the respective chamber. Also, the ends of the caps may be shaped to enhance air flow or thermal transmission.

Figure 12:
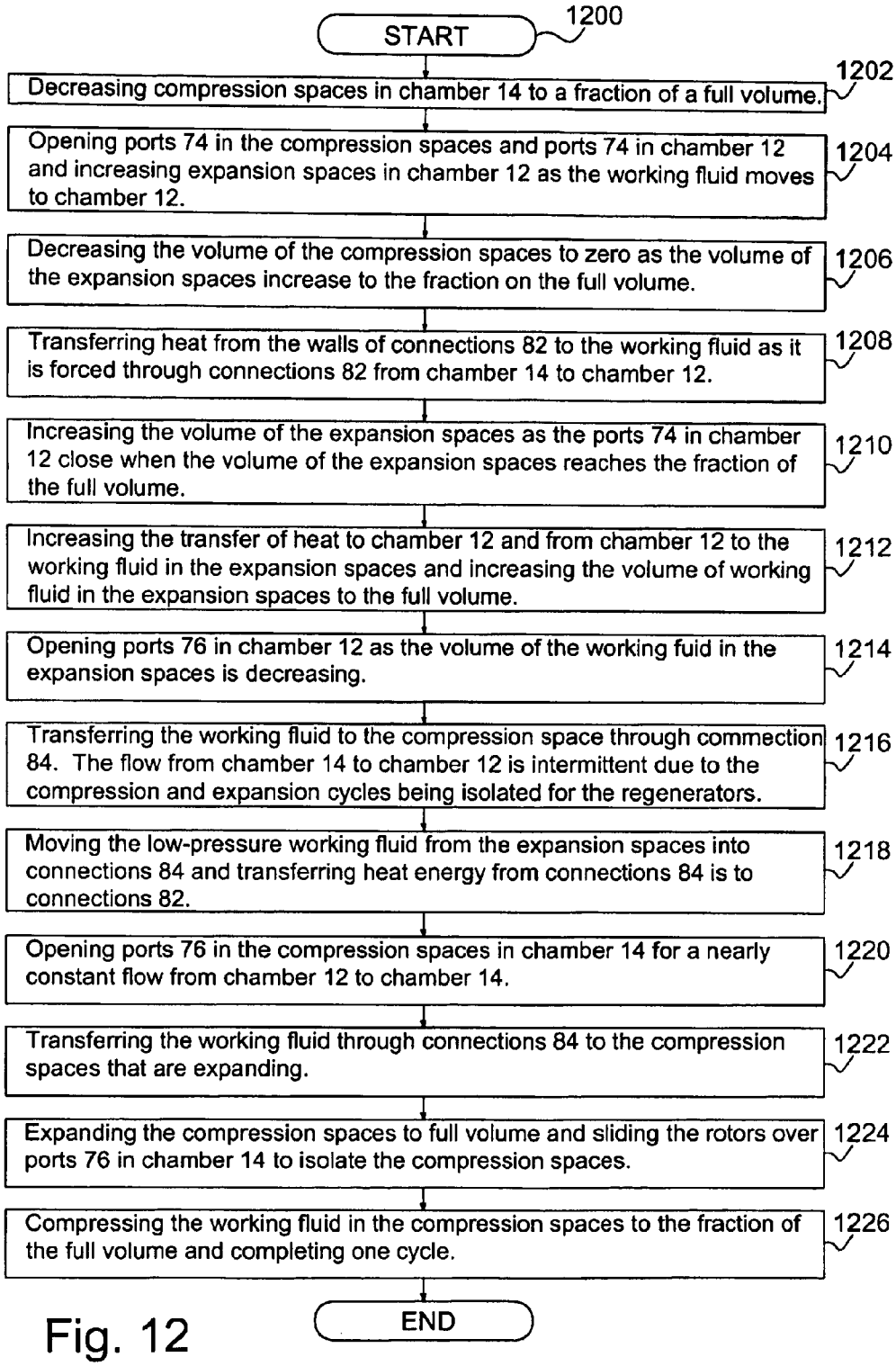
FIG. 12 is a flow chart illustrating a thermodynamic cycle in a present invention engine.

FIG. 12 is a flow chart illustrating a thermodynamic cycle in a present invention engine. Although the method in FIG. 12 is depicted as a sequence of numbered steps for clarity, no order should be inferred from the numbering unless explicitly stated. The phasing described below is for a Stirling Cycle. It should be understood that other phasing may be used and that the gears and phases between the chambers 12 and 14 need not be symmetrical. Gear train 34 can be modified so that the drive system for the chambers is changed, either dynamically or statically, to change the phase relations and thus the compression, transfer, and expansion associated with the two chambers. The method starts at Step 1200. Step 1202 decreases the volume of compression spaces in chamber 14 to a fraction of a full volume. This compression is isolated from the regenerator since the compression takes place in an area of the chamber that does not have port openings (that is, rotors 44 and 46 are blocking ports 74 and 76). Step 1204 opens ports 74 in the compression spaces in chamber 14 and ports 74 in chamber 12. Then, the volume of the expansion spaces associated with the open ports 74 in chamber 12 increases from zero as the working fluid moves from chamber 14 to chamber 12. Step 1206 decreases the volume of the compression spaces to zero as the volume of the expansion spaces increases to the fraction of a full volume. This is an essentially constant volume transfer from chamber 14 to chamber 12 through connection 82. Step 1208 transfers heat from the walls of connection 82 to the working fluid as the working fluid is forced through connection 82 from chamber 14 to chamber 12. Step 1210 closes the ports 74 in chamber 12 when the volume of the expansion spaces reaches the fraction of a full volume. The volume of the expansions spaces continues to increase. Step 1212 transfers heat to cap 18 from the heat reservoir and from cap 18 to the working fluid in the expansion spaces. The volume of working fluid in the expansion spaces increases to the full volume. Step 1214 opens ports 76 to expansion spaces in chamber 12 as the volume of the working fluid in the expansion spaces is decreasing. Step 1216 transfers the working fluid to the compression spaces through connection 84. The flow from chamber 14 to chamber 12 is intermittent due to the compression and expansion cycles being isolated from the regenerators. This isolation is a result of the rotors passing over the ports. Step 1218 moves the low-pressure working fluid from the expansion spaces into connections 84 and transfers heat energy from connections 84 to connections 82. Step 1220 opens ports 76 in chamber 14. Flow from both sets of expansion spaces in chamber 12 overlap into connections 84. The flow from chamber 12 to chamber 14 is nearly constant. Step 1222 transfers the working fluid through connection 84 to the compression spaces, which is expanding. Step 1224 expands the compression spaces to full volume and then the rotors slide over port 76 to isolate the compression spaces. Step 1226 compresses the working fluid in the compression spaces to the fraction of the full volume and completes one cycle.

Figure 13:
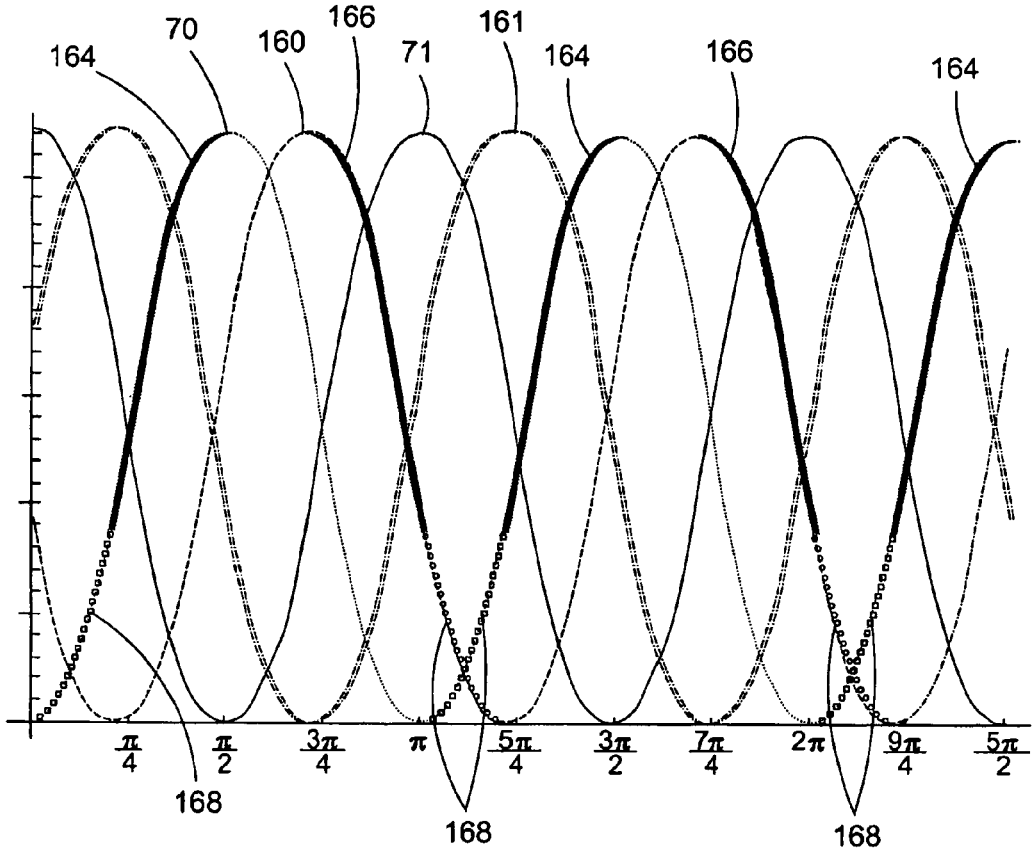
FIG. 13 is a graph showing compression and expansion cycles in a present invention engine.
Figure 14A:
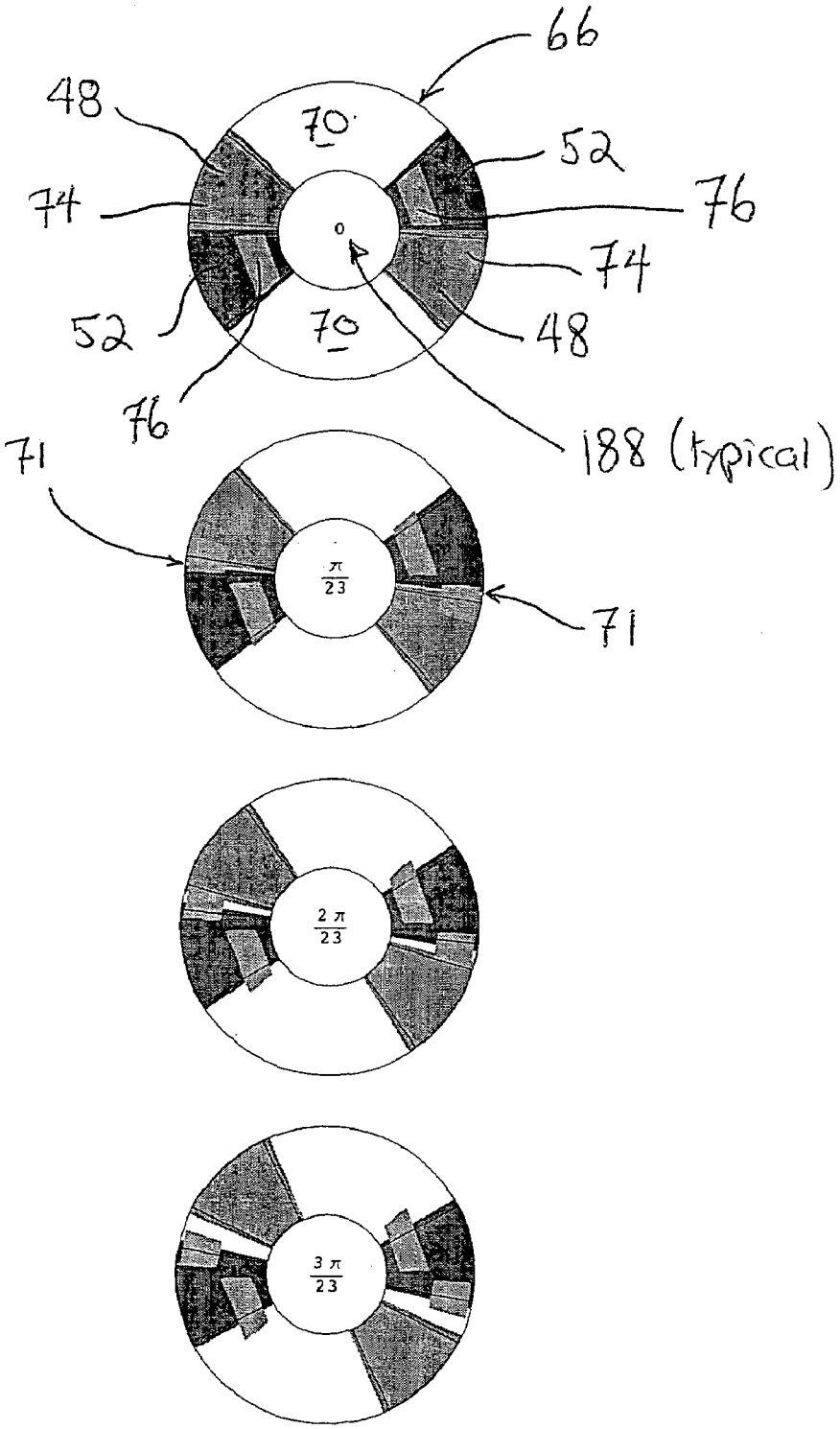
FIGS. 14A-14F show the movement of the rotor lobes in the expansion chamber.
Figure 14B:
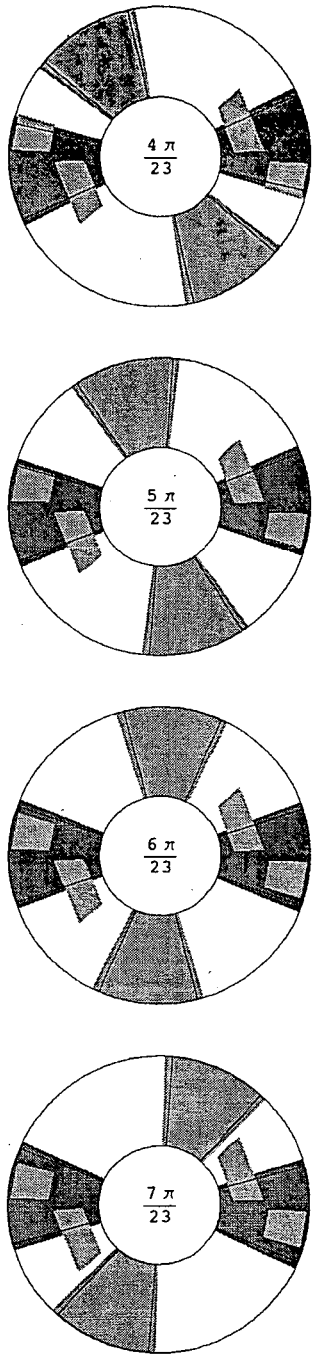
Figure 14C:
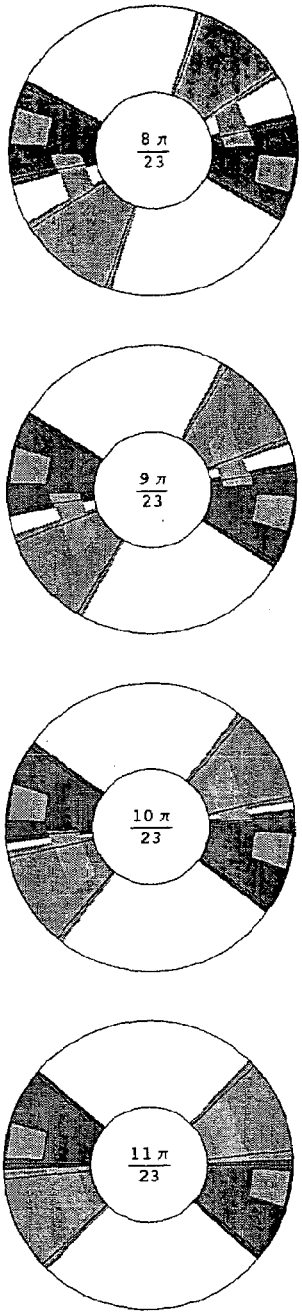
Figure 14D:
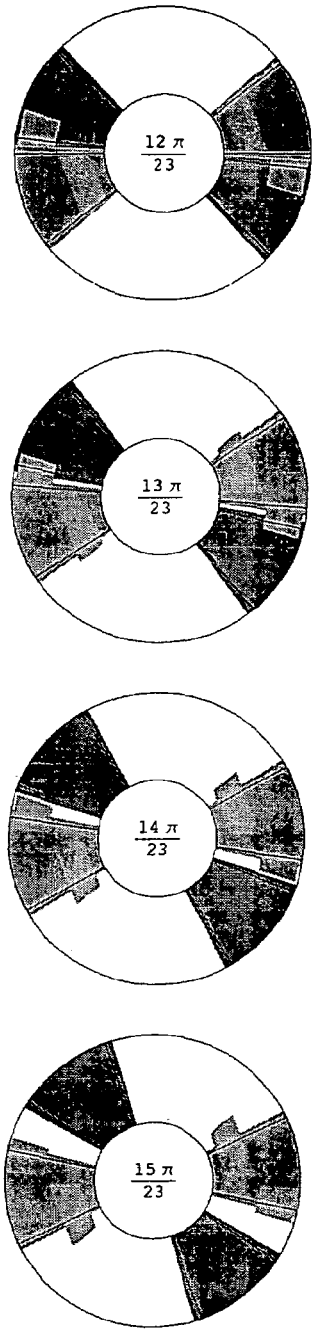
Figure 14E:
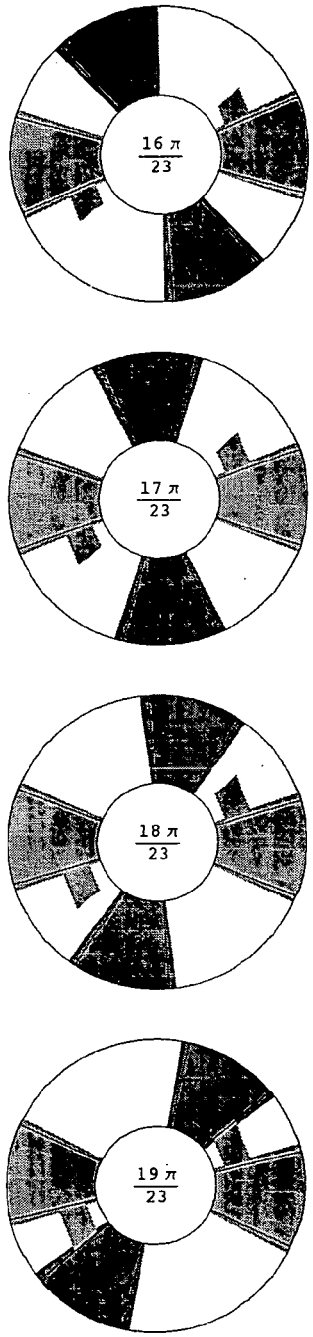
Figure 14F:
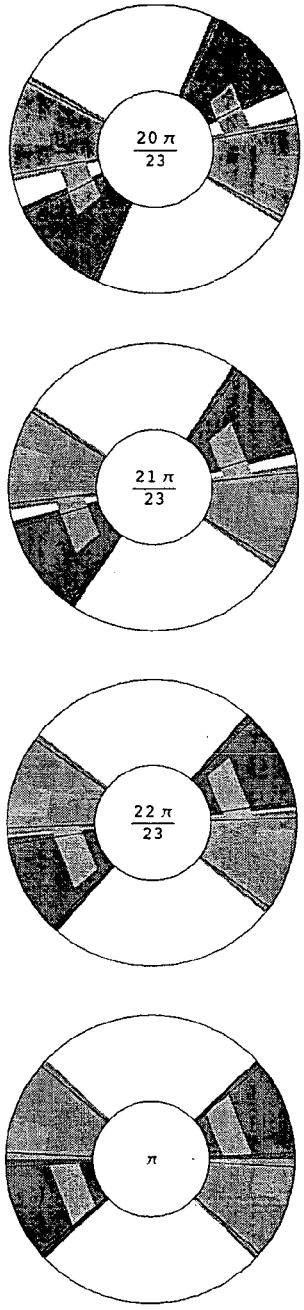
Figure 15A:
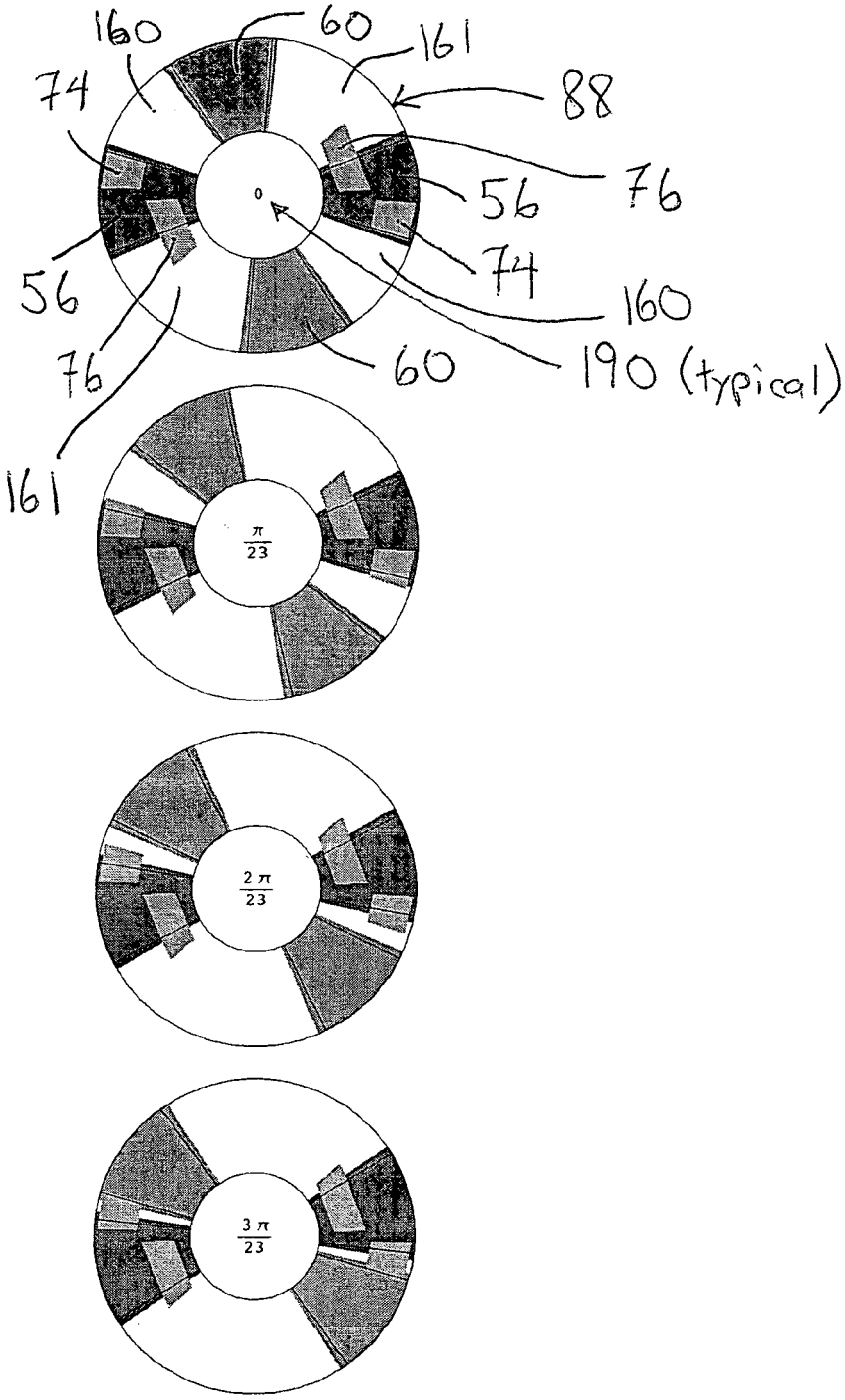
FIGS. 15A-15F show the movement of the rotor lobes in the compression chamber.
Figure 15B:
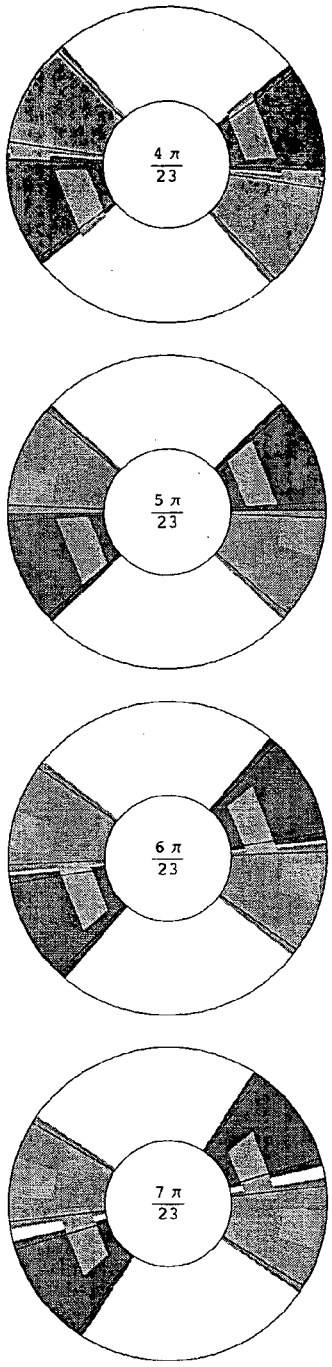
Figure 15C:
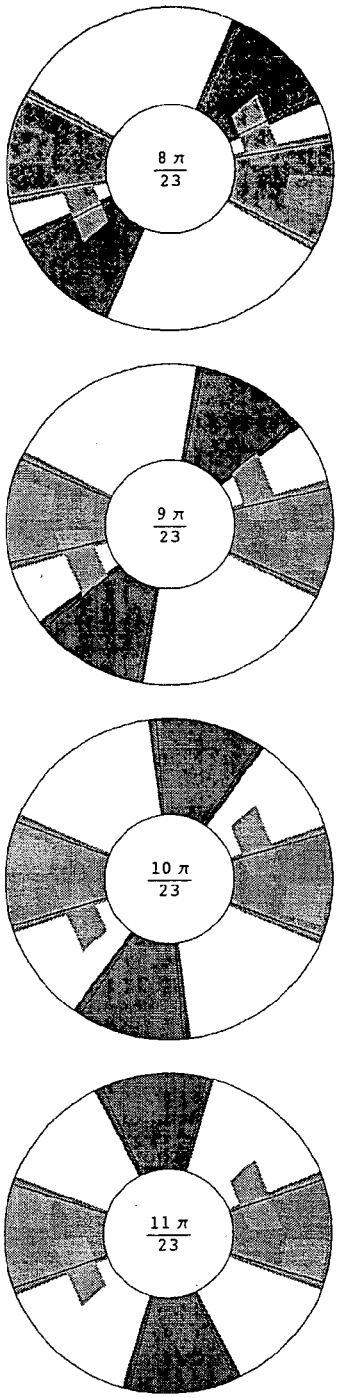
Figure 15D:
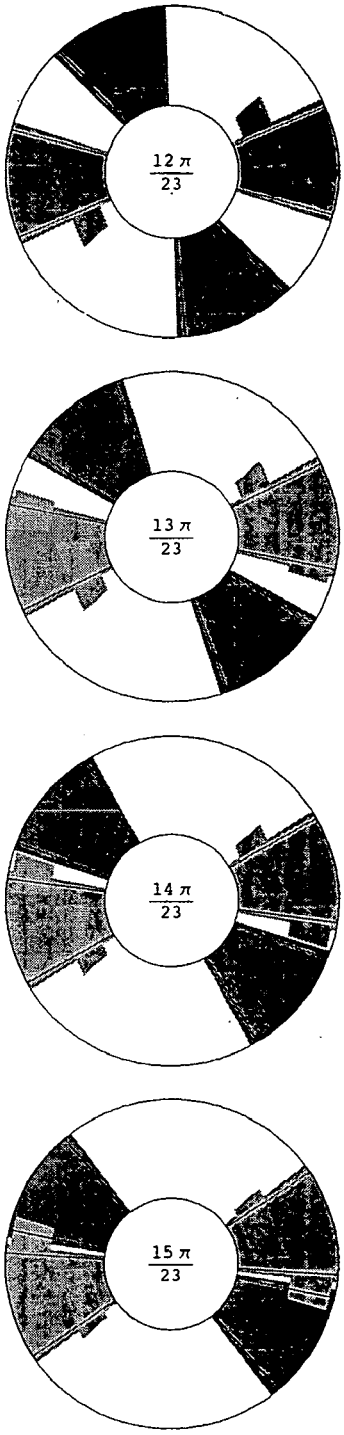
Figure 15E:
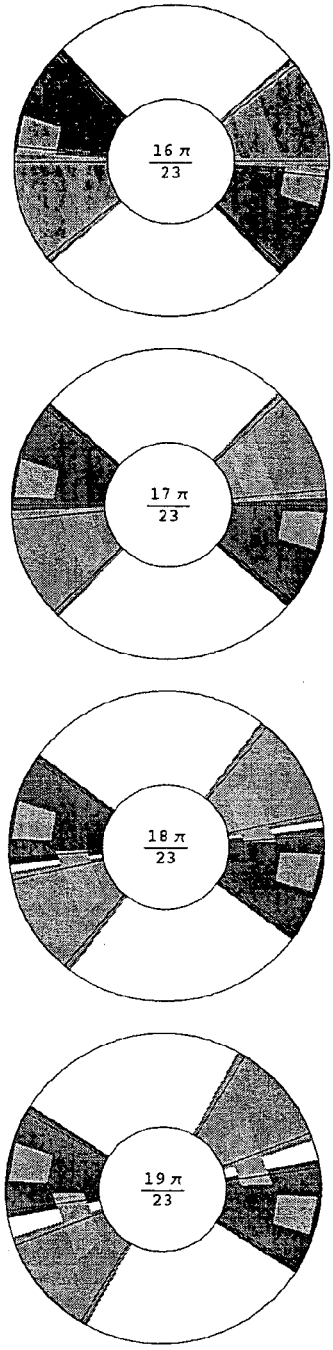
Figure 15F:
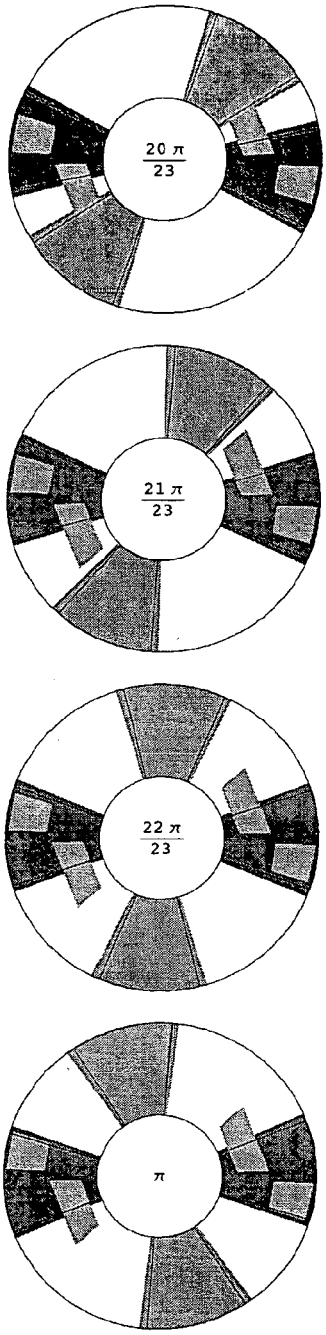

FIG. 13 is a graph showing compression and expansion cycles in engine 10. The vertical axis for FIG. 13 is a unit less measure of volume. The horizontal axis is rotation of the rotors in radians. Rotors 40 and 42 form a pair of expansion spaces 70 and 71 in chamber 12. In a similar manner, rotors 44 and 46 form a pair of compression spaces 160 and 161 (not shown) in chamber 14. Volume changes for each of the pairs of expansion and compression spaces as the respective rotors rotate are shown in FIG. 13. The waveform corresponding to a particular pair of spaces is labeled with the number for that pair. The volumes vary in a sinusoidal manner between essentially zero (when opposing lobes are in contact) and a maximum value (when opposing lobes are at a maximum distance apart). The bold sections of the graph follow one cycle through compression in chamber 14 and expansion in chamber 12. That is, the bold sections follow the progress of a particular volume of fluid through engine 10. For example, sections 164 show the expansion of the fluid in spaces 70 and sections 166 show the compression of the fluid in spaces 160. The fluid moves in a cyclical manner between spaces 70 and 160. The dotted lines 168 represent the high pressure transfer of fluid from spaces 160 to spaces 70 through connector 82.

Figure 19:
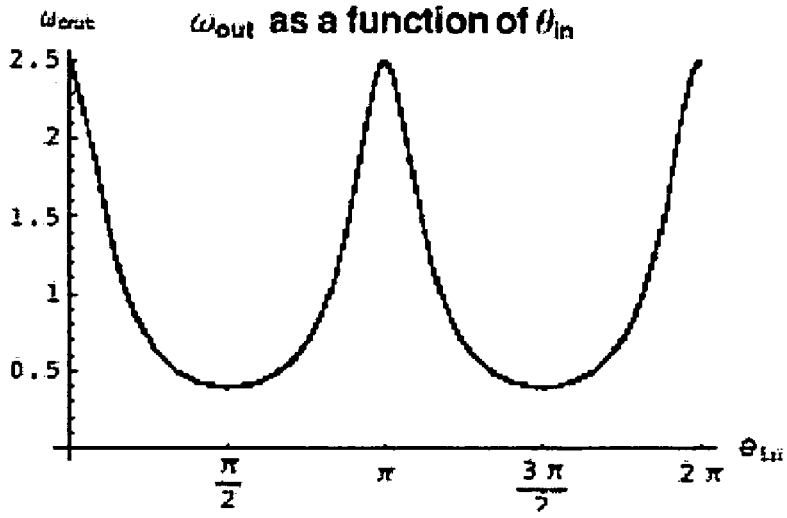
FIG. 19 shows $\omega_{out}$ as a function of $\theta_{in}$ for the modeling of the gears in the engine shown in FIG. 1.

FIG. 19 shows $\omega_{out}$ as a function of $\theta_{in}$ for the modeling of the gears in engine 10. FIG. 19 is based on the gear equations below. The performance of engine 10 was modeled using BE2 modeling as follows:

5:1 Gear Ratio Rotor Modeling

Mathematica Set Up

All angles are in radians

<<Graphics 'Graphics'

<<Graphics 'Colors'

<<Graphics 'FilledPlot'

<<Graphics 'Animation'

Gear Equations $r_a$=2.5; $r_b$=1; k=$r_a/r_b$; $w_{in}$=1; n=2;

$$\theta_{out}[\theta_] := \text{IntegerPart}\left[\frac{\theta+\pi/2}{\pi}\right](\pi) + \left(\frac{2(\text{ArcTan}[K\text{Tan}[n\theta]])}{2}\right);$$

$$\omega_{out}[\theta_] := \omega_{in}\left(\frac{K}{1+(K^2-1)\text{Sin}[n\theta/2]^2}\right),$$

Plot [$\omega_{out}[\theta_{in}]$, {$\theta_{in}$, 0, 2π},

PlotLabel→StyleForm["$\omega_{out}$ as a function of $\theta_{in}$", Subsection], $$\text{AxesLabel} \to \{\theta_{in}, \omega_{out}\}, \text{Ticks} \to \left\{\left\{0, \frac{\pi}{2}, \pi, \frac{3\pi}{2}, 2\pi\right\}, \text{Automatic}\right\}\Big]$$

Rotor and Chamber Set Up

The ports as drawn in this modeling are not shaped as the device would be constructed. Only the arc angle, used for deermining the open and closed ports, is accurate.

Seals are drawn to approximate the 'H' type, and again only the arc angles are used.

δCD is the initial position adjustment for the lower rotor pair.

γCD is the phase difference between the upper and lower rotor pair.

Rotor dimentions are 100 mm $R_{max}$, 40 mm $R_{min}$, and 37 mm in depth.

Arc is a function of the elliptical gear shape.

$\alpha AB_{in}$, $\alpha AB_{out}$, $\alpha CD_{in}$, $\alpha CD_{out}$, are port positions on the base.

ξ in the inset of the seal from the edge of the rotor

δCD=0;

γCD=150π/529;

$R_{max}$=100; $R_{min}$=40; $R_{depth}$=37;

Arc=0.76;

$\alpha AB_{in}=\alpha CD_{in}$=−InPortRad−ξ;

$\alpha AB_{out}=\alpha CD_{out}$=ξ;

ξ=0.05; SealArc=Arc−2ξ;

InPortMin=73; InPortMax=98; InPortRad=0.25;

OutPortMin=50; OutPortMax=70; OutPortRad=SealArc;

$\theta A=-\theta_{out}[t+3\pi/4]+\theta_{out}[3\pi/4]$;

$\theta B=\theta_{out}[t+\pi/4]+Arc+\theta_{out}[\pi/4]$;

$\theta C=\theta_{out}[t+3\pi/4+\gamma CD]+\delta CD+Arc-\theta_{out}[3\pi/4]$ $\theta D=\theta_{out}[t+\pi/4\gamma CD]\alpha\delta Cd-\theta_{out}[\pi/4]$;

$BStart=-\theta_{out}[0.0001+\pi/2]+\delta AB+\theta_{out}[0.0001+\pi/2]$;

Backing=Graphics[{{GrayLevel [1], Disk[{0, 0}, $R_{min}$]}, Circle[{0, 0}, $R_{min}$], Circle[{0, 0}, $R_{max}$], Text[t, {0, 0}]}];

Ports=Graphics[(

{GrayLevel[0.7],

Polygon[{{InPortMin Cos [$\alpha AB_{in}$], InPortMin Sin [$\alpha AB_{in}$]},

{InPortMax Cos [$\alpha AB_{in}$], InPortMax Sin [$\alpha AB_{in}$]},

{InPortMax Cos [$\alpha AB_{in}$+InPortRad], InPortMax Sin [$\alpha AB_{in}$+InPortRad]}, {InPortMin Cos [$\alpha AB_{in}$+InPortRad], InPortMin Sin [$\alpha AB_{in}$+InPortRad]}}], Polygon[{{InPortMin Cos [$\alpha AB_{in}+\pi$], InPortMin Sin [$\alpha AB_{in}+\pi$]}, {InPortMax Cos [$\alpha AB_{in}+\pi$], InPortMax Sin [$\alpha AB_{in}$+]]}, {InPortMax Cos [$\alpha AB_{in}$+InPortRad+$\pi$], InPortMax Sin [$\alpha AB_{in}$+InPortRad+$\pi$]}, {InPortMin Cos [$\alpha AB_{in}$+InPortRad+$\pi$], InPortMin Sin [$\alpha AB_{in}$+InPortRad+$\pi$]}}], Polygon[{{OutPortMin Cos [$\alpha AB_{out}$}], OutPortMin Sin [$\alpha AB_{out}$]}, {OutPortMax Cos [$\alpha AB_{out}$], OutPortMax Sin [$\alpha AB_{out}$]}, {OutPortMax Cos [$\alpha AB_{out}$+OutPortRad], OutPortMax Sin[$\alpha AB_{out}$+OutPortRad]}, {OutPortMin Cos [$\alpha AB_{out}$+OutPortRad], OutPortMin Sin [$\alpha AB_{out}$+OutPortRad]}}], Polygon[{(OutPortMin Cos [$\alpha AB_{out}+\pi$], OutPortMin Sin [$\alpha AB_{out}+\pi$]}, {OutPortMax Cos [$\alpha AB_{out}+\pi$], OutPortMax Sin [$\alpha AB_{out}+\pi$]}, {OutPortMax Cos [$\alpha AB_{out}$+OutPortRad+$\pi$], OutPortMax Sin [$\alpha AB_{out}$+OutPortRad+$\pi$]}, {OutPortMin Cos [$\alpha AB_{out}$+OutPortRad+$\pi$], OutPortMin Sin [$\alpha AB_{out}$+OutPortRad+$\pi$]}}]}}];

$T_h$ Rotor Graphic Construction

Arc is the arc of the rotor in radian.

$\xi$ is the angle the seal is set back from the rotor edge.

SealArc is the arc angle of the seals

Arotor=Graphics[{GrayLevel[0.6],

Disk[{0, 0}, $R_{max}$, {$\theta$A−Arc, $\theta$A}], Disk[{0, 0}, $R_{max}$, ($\theta$A+$\pi$−Arc, $\theta$A+$\pi$}]}];

ASealTrail=Graphics[Line[{{$R_{max}$ Cos [$\theta$A−Arc+$\xi$+SealArc+$\pi$], $R_{max}$ Sin [$\theta$A−Arc+$\xi$+SealArc+$\pi$]}, {$R_{max}$ Cos [$\theta$A−Arc+$\xi$+SealArc], $R_{max}$ Sin [$\theta$A−Arc+$\xi$+SealArc]}}]];

ASealLead=Graphics[Line[{{$R_{max}$ Cos [$\theta$A−Arc+$\xi+\pi$], $R_{max}$ Sin [$\theta$A−Arc+$\xi+\pi$]}, {$R_{max}$ Cos [$\theta$A−Arc+$\xi$], $R_{max}$ Sin [$\theta$A−Arc+$\xi$]}}]];

Brotor=Graphics[{GrayLevel[1.4],

Disk[{0,0), $R_{max}$, ($\theta$B−Arc, $\theta$B}], Disk[{0,0), $R_{max}$, {$\theta$B +$\pi$−Arc, $\partial$B+$\pi$}]}];

BSealTrail=Graphics[Line[{{$R_{max}$ Cos [$\theta$B−Arc+$\xi$+SealArc+$\pi$], $R_{max}$ Sin [$\theta$B−Arc+$\xi$+SealArc+]]}, {$R_{max}$ Cos [$\theta$B−Arc+$\xi$+SealArc], $R_{max}$ Sin [$\theta$B−Arc+$\xi$+SealArc]}}]];

BSealLead=Graphics[Line[{{$R_{max}$ Cos [$\theta$B−Arc+$\xi+\pi$], $R_{max}$ Sin [$\theta$B−Arc+$\xi+\pi$]}, {$R_{max}$ Cos [$\theta$B−Arc+$\xi$], $R_{max}$ Sin [$\theta$B−Arc+$\xi$]}};

$T_c$ Rotor Graphic Construction

Crotor=Graphics[{GrayLevel[0.6],

Disk[{0,0}, $R_{max}$, {$\theta$C−Arc, $\theta$C{], Disk[{0, 0}, $R_{max}$, {$\theta$C+$\pi$−Arc, $\theta$C+$\pi$}]}];

CSealTrail=

Graphics[Line[{{$R_{max}$ Cos [$\theta$C−Arc+$\xi$+SealArc+$\pi$], $R_{max}$ Sin [$\theta$C−Arc+$\xi$+SealArc+$\pi$]}, {$R_{max}$ Cos [$\theta$C−Arc+$\xi$+SealArc], $R_{max}$ Sin [$\theta$C−Arc+$\xi$+SealArc]}}]];

CSealLead=Graphics[Line[{{$R_{max}$ Cos [$\theta$C−Arc+$\xi+\pi$], $R_{max}$ Sin [$\theta$C−Arc+$\xi+\pi$]}, {$R_{max}$ Cos [$\theta$C−Arc+$\xi$], $R_{max}$ Sin [$\theta$C−Arc+$\xi$]}}]];

Drotor=Graphics[{GrayLevel[0.4],

Disk[{0, 0}, $R_{max}$, {$\theta$D−Arc, $\theta$D}], Disk[{0, 0}, $R_{max}$, {$\theta$D+$\pi$−Arc, $\theta$D+$\pi$}]}];

DSealTrail=

Graphics[Line[{{$R_{max}$ Cos [$\theta$D−Arc+$\xi$+SealArc+$\pi$], $R_{max}$ Sin [$\theta$D−Arc+$\xi$+SealArc+$\pi$]}, {$R_{max}$ Cos [$\theta$D−Arc+$\xi$+SealArc], $R_{max}$ Sin [$\theta$D−Arc+$\xi$+SealArc]}}]];

DSealLead=Graphics[Line [{{$R_{max}$ Cos [$\theta$D−Arc+$\xi+\pi$], $R_{max}$ Sin [$\theta$D−Arc+$\xi+\pi$]}, {$R_{max}$ Cos [$\theta$D−Arc+$\xi$], $R_{max}$ Sin [$\theta$D−Arc+$\xi$]}}]];

FIGS. 14A-14F show the movement of rotor lobes 48 and 52 in expansion chamber 12. FIGS. 14A-14F are produced by the $T_h$ animation in BE2 shown below. FIGS. 14A-14F are a radial cross-sectional view of chamber 12 showing the motion of lobes 48 and 52 through one half rotation of rotors 50 and 54, which completes one cycle in engine 10. The rotation of the shafts is shown by 188. FIGS. 14A-14F show the oscillating movement of lobes 48 and 52 and the subsequent changes in the sizes of spaces 70 and 71. FIGS. 14A-14F also show the blocking and uncovering of the ports 74 and 76 during a cycle.

$T_h$ Rotor Animation (AB)

Start=0; Stop=$\pi$;

Animate[{Arotor, Brotor, Ports, ASealLead, ASealTrail, BSealLead, BSealTrail, Backing), (t, Start, Stop/2), AspectRatio→Automatic];

FIGS. 15A-15F show the movement of the rotor lobes in the compression chamber. FIGS. 14A-14F are produced by the $T_1$ animation referenced above. FIGS. 15A-15F show the movement of rotor lobes 56 and 60 in compression chamber 14. FIGS. 15A-15F are a radial cross-sectional view of chamber 14 showing the motion of lobes 56 and 60 through one half rotation of rotors 58 and 62, which completes one cycle in engine 10. The rotation of the shafts is shown by 190. FIGS. 15A-15F show the oscillating movement of lobes 56 and 60 and the subsequent changes in the sizes of spaces 160 and 161. FIGS. 15A-15F also show the blocking and uncovering of the ports 74 and 76 during a cycle. FIGS. 14A-14F and FIGS. 15A-15F also show the phasing of the expansion and compression rotors with respect to each other.

$T_1$ Rotor Animation (CD)

Animate[(Crotor, Drotor, Ports, CSealLead, CSealTrail, DSealLead, DSealTrail, Backing}, {t, Start, Stop}, AspectRatio→Automatic];

FIGS. 13 is representative of the following further modeling using BE2:

5:1 Volume, Phasing Equations and Plots

V=$\pi$/2;

VolMax=Abs]

(((−$\theta_{out}$[V+$\pi$/4]+$\delta$AB+Arc+$\theta_{out}$[$\pi$/4])−Arc)−(−$\theta_{out}$[V+3$\pi$/4]+$\delta$AB+$\theta_{out}$[3$\pi$/4]))

($R_{max}^2$−$R_{min}^2$)/10];

ABVolume=Plot[Abs[(($\theta$B−Arc)−$\theta$A)($R_{max}^2$−$R_{min}^2$)/10], {t, 0, 5$\pi$/2}, PlotStyle→{Dashing[{0.04, 0.005, 0.003, 0.005}]}];

BAVolume=Plot[−Abs[(($\theta$B−Arc)−$\theta$A) ($R_{max}^2$−$R_{min}^2$)/10]+Volmax, {t, 0, 5$\pi$/2), PlotStyle→{Dashing[{0.04, 0.005, 0.003, 0.005, 0.003, 0.005}], RGBColor[1, 0, 0]}];

CDVolume=Plot[Abs[(($\theta$C−Arc)−$\theta$D) ($R_{max}^2$−$R_{min}^2$)/10], (t, 0, 5$\pi$/2}, PlotStyle→{Dashing[{0.04, 0.005, 0.003, 0.005, 0.003, 0.005, 0.003, 0.005}], RGBColor[0, 1, 0]}];

DCVolume=Plot[−Abs[[((θC−Arc)−θD) ($R_{max}^2R_{min}^2$)/10]+VolMax, {t, 0, 5π/2},
PlotStyle→
{Dashing[{0.04, 0.005, 0.003, 0.005, 0.003, 0.005, 0.003, 0.005, 0.003, 0.005}],
RGBColor[0, 0, 1]}];
aCDActive=Plot[−Abs[((θC−Arc)−θD) ($R_{max}^2$−$R_{min}^2$/10]+VolMax, {t, 0, 5π/23},
PlotStyle→{Dashing[{0.002, 0.01}],
Thickness[0.007], RGBColor[0, 0, 1]}];
aABActive=Plot[Abs[((θB−Arc)−θA) ($R_{max}^2$−$R_{Min}^2$)/10], {t, 0, π/2},
PlotStyle→{Dashing[{0.002, 0.01}],
Thickness[0.007]}];
aABExpand=Plot[Abs[((θB−Arc)−θA) ($R_{max}^2$−$R_{min}^2$)/10], {t, 5π/23, π/2},
PlotStyle→{Thickness[0.01]}];
bCDCompress=
Plot[−Abs[((θC−Arc)−θD) ($R_{max}^2$−$R_{min}^2$)/10]+VolMax, {t, 5π/23+π2, π},
PlotStyle→(Thickness[0.01], RGBColor[0, 0, 1]}];
bCDActive=
Plot[−Abs[((θC−Arc)−θD) ($R_{max}^2$−$R_{min}^2$)/10]+VolMax, (t, 5π/23+π/2, 5π/23+π},
PlotStyle→{Dashing[{0.002, 0.01}],
Thickness[0.007, RGBColor[0, 0, 1]}];
cABActive=Plot[Abs[((θB−Arc)−θA) ($R_{max}^2$−$R_{min}^2$)/10], {t, π, 3π/2},
PlotStyle→{Dashing[{0.002, 0.01}],
Thickness[0.007]}];
cABExpand=Plot[Abs[((θB−Arc)−θA) ($R_{max}^2$−$R_{min}^2$)/10], {t, 5π/23+π, 3π/2},
PlotStyle→{Thickness[0.01]}];
dCDCompress=
Plot[−Abs[((θC−Arc)−θD) ($R_{max}^2$−$R_{min}^2$)/10]+VolMax, {t, 5π/23+3π/2, 2π},
PlotStyle→{Thickness[0.01], RGBColor[0, 0, 1]}];
dCDActive=Plot[
−Abs[((θC−Arc)−θD) ($R_{max}^2$−$R_{min}^2$)/10]+VolMax, {t, 5π/23+3π/2, 5π/23+2π},
PlotStyle→{Dashing[{0.002, 0.01}],
Thickness[0.007, RGBColor[0, 0, 1]}];
eABActive=Plot[Abs[((θB−Arc)−θA) ($R_{max}^2$−$R_{min}^2$)/10], {t, 2π, 5π/2},
PlotStyle→{Dashing[{0.002, 0.01}],
Thickness[0.007]}];
eABExpand=Plot[Abs[((θB−Arc)−θA) ($R_{max}^2$−$R_{min}^2$)/10], {t, 5π/23+2π, 5π/2},
PlotStyle→{Thickness[0.01]}];
Show[{ABVolume, BAVolume, CDVolume, DCVolume,
aCDActive, aABActive, aABExpand, bCDCompress, bCDActive, cARActive,
cABExpand, dCDCompress, dCDActive, eABActive, eABExpand}, $$\text{Ticks} \rightarrow \left\{\left\{0, \frac{\pi}{4}, \frac{\pi}{2}, \frac{3\pi}{4}, \pi, \frac{5\pi}{4}, \frac{3\pi}{2}, \frac{7\pi}{4}, 2\pi, 9\pi/4, 5\pi/2,\right\}\text{Automatic}\right\}\Big]:$$

Figure 16:
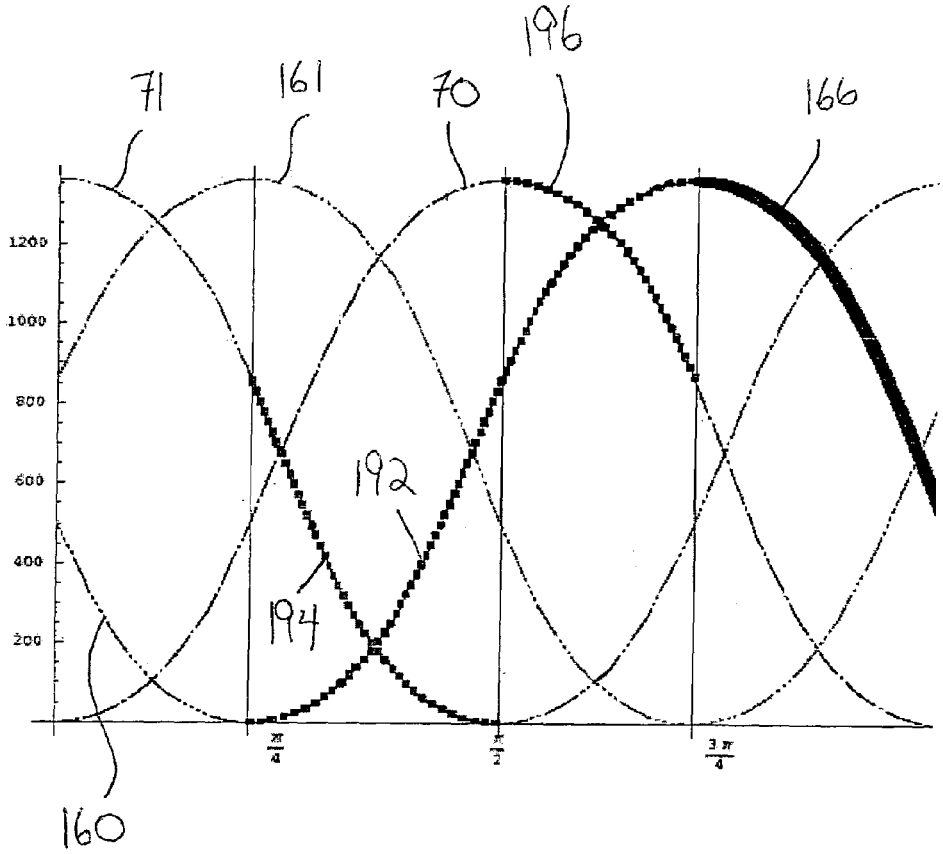
FIG. 16 is a graph showing the compression and expansion cycles in the engine.

FIG. 16 is a graph showing the compression and expansion cycles in engine 10. FIG. 16 is based on the following further modeling using BE2:

ABVolume=Plot[Abs[((θB−Arc)−θA) ($R_{max}^2$−$R_{min}^2$)/10], {t, 0, π},
PlotStyle→{Dashing[{0.04, 0.005, 0.003, 0.005}]}];
BAVolume=Plot[−Abs[((θB−Arc)−θA) ($R_{max}^2$−$R_{min}^2$)/[10]+VolMax, {t, 0, π},
PlotStyle→{Dashing[{0.04, 0.005, 0.003, 0.005, 0.003, 0.005}],
RGBColor[1, 0, 0]}];
CDVolume=Plot[Abs[((θC−Arc)−θD) ($R_{max}^2$−$R_{min}^2$)/10], {t, 0, π},
PlotStyle→{Dashing[{0.04, 0.005, 0.003, 0.005, 0.003, 0.005, 0.003, 0.005}],
RGBColor[0, 1, 0]}];
DCVolume=Plot[−Abs[((θC−Arc)−θD) ($R_{max}^2$−$R_{min}^2$)/10]+VolMax, {t, 0, π},
PlotStyle→
{Dashing[{0.04, 0.005, 0.003, 0.005, 0.003, 0.005, 0.003, 0.005, 0.003, 0.005}],
RGBColor[0, 0, 1]}];
bCDCompress=
Plot[−Abs[((θC−Arc)−θD) ($R_{max}^2$−$R_{min}^2$)/10]+VolMax, (t, 5π/23+π/2, π},
PlotStyle→{Thicknes[0.01], RGBColor[0, 0, 1]}];
bCDActive=Plot[−Abs[((θC−Arc)−θD) ($R_{max}^2$−$R_{min}^2$)/10]+VolMaX, {t, 5π/23, π},
PlotStyle→}Dashing[{0.002, 0.01}],
Thickness[0.007], RGBColor[0, 0, 1]}]
RedT=Plot[−Abs[((θB−Arc)−θA) ($R_{max}^2$−$R_{min}^2$)/10]+VolMax, {t, 5π/23, π/2},
PlotStyle→{Dashing[{0.002, 0.01}],
Thickness[0.007], RGBColor[1, 0, 0]}];
BackT=Plot[Abs[((θB−Arc)−θA) ($R_{max}^2$−$R_{min}^2$)/10], {t, π/2, 5π/23+π/2},
Plotstyle→{Dashing[{0.002, 0.01}],
Thickness[0.007]}];
Show[{ABVolume, BAVolume, CDVolume, DCVolume, bCDCompress, bCDActive, RedT, BlackT}, $$\text{Ticks} \rightarrow \left\{\left\{0, \frac{\pi}{4}, \frac{\pi}{2}, \frac{3\pi}{4}, \pi\right\}, \text{Automatic}\right\},$$

Figure 17:
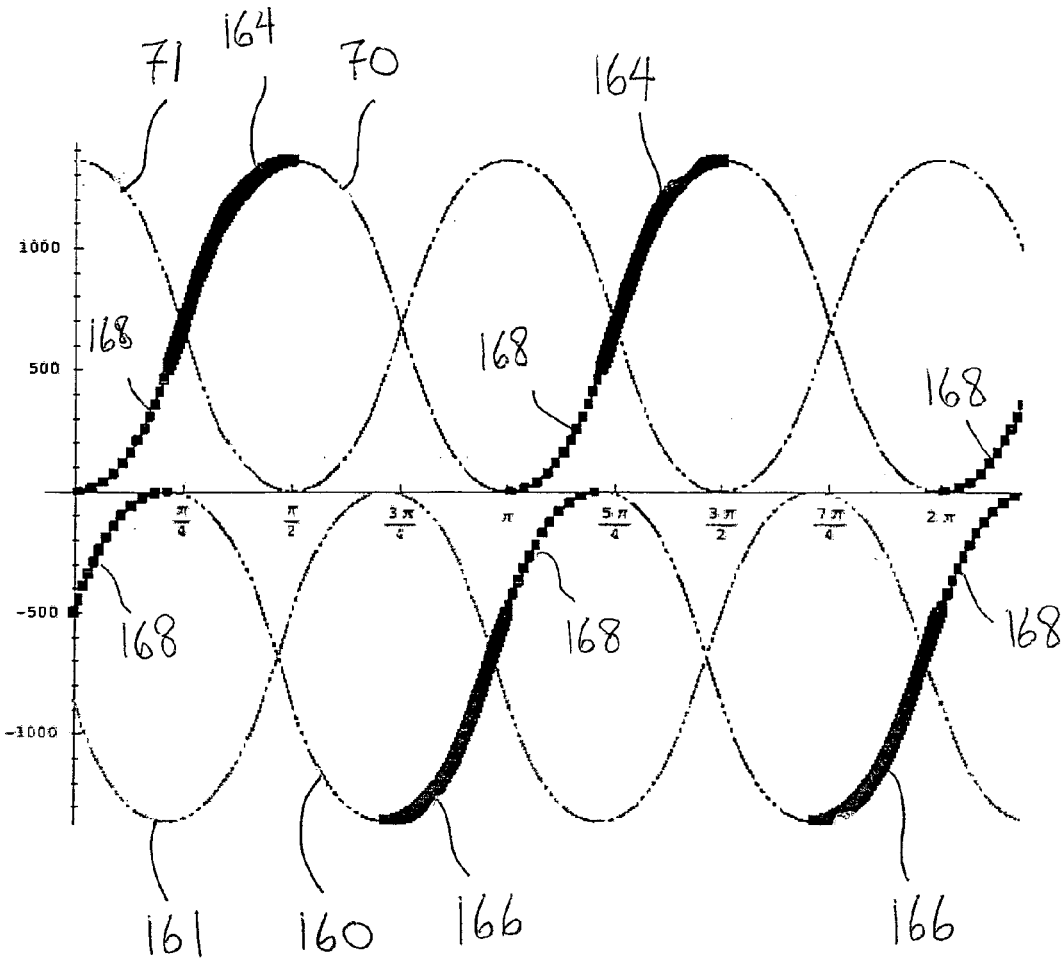
FIG. 17 is a graph separating the compression and expansion cycles shown in FIG. 13; and, FIG. 18 is a graph showing the compression and expansion cycles in the engine.

GridLines→{{5π/23, π/2, 5π/23+π/2), None];

FIG. 17 is a graph separating the compression and expansion cycles shown in FIG. 13. FIG. 16 is based on the following further modeling using BE2:

ABVolume=Plot[Abs [((θB−Arc)−θA) ($R_{max}^2$−$R_{min}^2$)/10], {t, 0, 5π/2},
PlotStyle→{Dashing[{0.04, 0.005, 0.003, 0.005}];

BAVolume=Plot[−Abs[((θB−Arc)−θA) ($R_{max}^2$−$R_{min}^2$)/10]+VolMax, {t, 0, 5π/2},
PlotStyle→{Dashing[{0.04, 0.005, 0.003, 0.005, 0.003, 0.005}],
RGBColor[1, 0, 0]}];

CDVolume=Plot[−Abs[((θC−Arc)−θD) ($R_{max}^2$−$R_{min}^2$)/10], {t, 0, 5π/2},
PlotStyle→{Dashing[{0.04, 0.005, 0.003, 0.005, 0.003, 0.005, 0.003, 0.005}],
RGBColor[0, 1, 0]}];

DCVolume=Plot[Abs[((θC−Arc}−θD) ($R_{max}^2$−$R_{min}^2$)/10]−VolMax, {t, 0, 5π/2},
PlotStyle→
{Dashing[{0.04, 0.005, 0.003, 0.005, 0.003, 0.005, 0.003, 0.005, 0.003, 0.005}],
RGBColor[0, 0, 1]}];

aCDActive=Plot[Abs[((θC−Arc)−θD) ($R_{max}^2$−$R_{min}^2$)/10]−VolMax, {t, 0, 5π/23}, PlotStyle→{Dashing[{0.002, 0.01}],
Thickness[0.007], RGBColor[0, 0, 1]}];

aABActive=Plot[Abs[((θB−Arc)−θA) ($R_{max}^2$−$R_{min}^2$)/10], {t, 0, π/2}},
PlotStyle→{Dashing[{0.002, 0.01}],
Thickness[0.007]}];

aABExpand=Plot[Abs[((θB−Arc)−θA) ($R_{max}^2$−$R_{min}^2$)/10], {t, 5π/23, π/2},
PlotStyle→{Thickness[0.01]}];

bCDCompress=
Plot[Abs [((θC−Arc)−θD) ($R_{max}^2$−$R_{min}^2$)/10]−VolMax, {t, 5π/23+π/2, π},
PlotStyle→{Thickness[0.01], RGBColor[0, 0, 1]}];

bCDOActive=
Plot[Abs [((θC−Arc) −θD) ($R_{max}^2$−$R_{min}^2$)/10]−VolMax, {t, 5π/23+ π/2, 5π/23+π},
PlotStyle→{Dashing[{0.002, 0.01}],
Thickness[0.007], RGBColor[0, 0, 1]}];

cABActive=Plot[Abs[((θB−Arc)−θA) ($R_{max}^2$−$R_{min}^2$)/10], {t, π, 3π/2},
PlotStyle→{Dashing[{0.002, 0.01}],
Thickness[0.007]}];

cABExpand=Plot[Abs [((θB−Arc)−θA) ($R_{max}^2$−$R_{min}^2$)/10], {t, 5π/23+π, 3π/2},
PlotStyle→{Thickness[0.01]}];

dCDCompress=
Plot[Abs[((θC−Arc)−θD) ($R_{max}^2$−$R_{min}^2$)/10]−VolMax, {t, 5π/23+3π/2, 2π},
PlotStyle→{Thickness[0.01], RGBColor[0, 0, 1]}];

dCDActive=Plot[
Abs[((θC−Arc)−θD) ($R_{max}^2$−$R_{min}^2$)/10]−VolMax, {t, 5π/23+3π/2, 5π/23+2π},
PlotStyle→{Dashing[{0.002, 0.01}],
Thickness[0.007], RGBColor[0, 0, 1]}];

eABActive=Plot[Abs[((θB−Arc)−θA) ($R_{max}^2$−$R_{min}^2$)/10], {t, 2π, 5π/2},
PlotStyle→{Dashing[{0.002, 0.01}],
Thickness[0.007]}];

eABExpand=Plot[Abs[((θB−Arc)−θA) ($R_{max}^2$−$R_{min}^2$)/10], {t, 5π/23+2π, 5π/2},
PlotStyle→{Thickness[0.01]}];

Show[{ABVolume, BAVolume, CDVolume, DCVolume, aCDActive, aABActive, aABExpand, bCDCompress, bCDActive, cABActive, cABExpand, dCDCompress, dCDActive, eABActive, eABExpand}, $$\text{Ticks} \rightarrow \left\{\left\{0, \frac{\pi}{4}, \frac{\pi}{2}, \frac{3\pi}{4}, \pi, \frac{5\pi}{4}, \frac{3\pi}{2}, \frac{7\pi}{4}, 2\pi, 9\pi/4, 5\pi/2,\right\}\text{Automatic}\right\}\Big];$$

Figure 18:
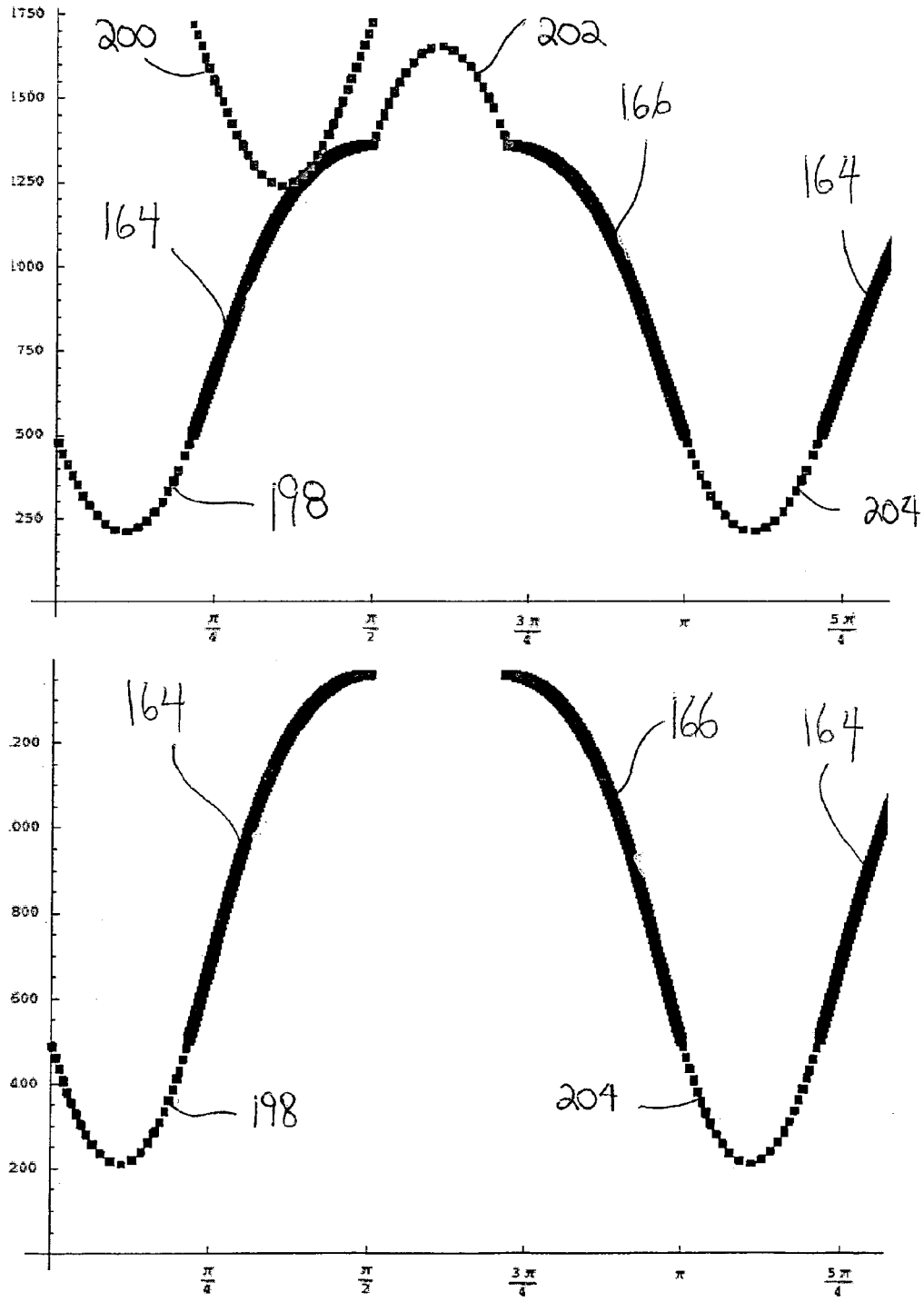

FIG. 18 is a graph showing the compression and expansion cycles in engine 10. FIG. 18 is based on the following further modeling using BE2:

Trans1=Plotf(Abs[((θB−Arc)−θA) ($R_{max}^2$−$R_{min}^2$)/10])−(Abs[((θC−Arc)−θD) ($R_{max}^{2-}$−$R_{min}^2$)/10]−VolMax), {t, 0, 5π/23},
PlotStyle→{Dashing[{0.002, 0.01}], Thickness[0.007], RGBColor[0,0,1]}];
Exp1=Plot[Abs[((θB−Arc)−θA) ($R_{max}^2$−$R_{min}^2$)/10], {t, 5π/23, π/2},
PlotStyle→{Thickness[0.01]}],
PushA=Plot[Abs[
(−Abs[((θB−Arc)−θA) ($R_{max}^2$−$R_{min}^2$)/10]+VolMax+860)−
(Abs[((θC−Arc)−θD) ($R_{max}^2$−$R_{min}^2$)/10]−VolMax)
], {t, π/2, 5π/23+π+π/2},
PlotStyle→{Dashing[{0.002, 0.01}],
Thickness[0.007], RGBColor[1, 0, 0]}]
PushB=Plot[Abs[
(Abs[((θB−Arc)−θA) ($R_{max}^2$−$R_{min}^2$)/10]−860)−
(Abs[((θC−Arc)−θD) ($R_{max}^2$−$R_{min}^2$)/10]−VolMax)
], {t, π/2, 5π/23+π/2},
PlotStyle→{Dashing[{0.002, 0.01}],
Thickness[0.007], RGEColor[1, 0, 0]}]
Comp1=Plot[−(Abs[((θC−Arc)−θD) ($R_{max}^2$−$R_{min}^2$)/10]−VolMax), (t, π, 5π/23+π/2, π},
PlotStyle→{Thickness[0.01], RGBColor[0, 0, 1]}];
Trans2=Plot[(Abs[((θB−Arc)−θA) ($R_{max}^2$−$R_{min}^2$)/10])−(Abs[((θC−Arc)−θD) ($R_{max}^2$−$R_{min}^2$)/10]−VolMax), {t, π, 5π/23+π},
PlotStyle→{Dashing[{0.002, 0.01}],
Thickness[0.007]}];
Exp2=Plot[Abs[((θB−Arc)−θA) ($R_{max}^2$−$R_{minm}^2$)/10], {t, 5π/23+π, 3π/2},
PlotStyle→{Thickness[0.01]}];
Show[{Trans1, Exp1, Comp1, Trans2, Exp2, PushA, PushB}, $$\text{Ticks} \rightarrow \left\{\left\{0, \frac{\pi}{4}, \frac{\pi}{2}, \frac{3\pi}{4}, \pi, \frac{5\pi}{4}, \frac{3\pi}{2}, \frac{7\pi}{4}, 2\pi, 9\pi/4, 5\pi/2,\right\}\text{Automatic}\right\}\Big];$$

Show[{Trans1, Exp1, Comp1, Trans2, Exp2}, $$\text{Ticks} \rightarrow \left\{\left\{0, \frac{\pi}{4}, \frac{\pi}{2}, \frac{3\pi}{4}, \pi, \frac{5\pi}{4}, \frac{3\pi}{2}, \frac{7\pi}{4}, 2\pi, 9\pi/4, 5\pi/2,\right\}\text{Automatic}\right\}\Big];$$

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What we claim is:

1. A thermodynamic cycle heat engine comprising:

a regenerator housing comprising first and second bi-directional regenerators, each said first and second bi-directional regenerator comprising a low pressure connection having a first volume and a high pressure connection having a second volume less than said first volume;

a compression chamber connected to a first end of said regenerator housing;

an expansion chamber connected to a second end of said regenerator housing and in fluid communication with said compression chamber via said first and second bi-directional regenerators, said first and second bi-directional regenerators, said compression chamber, and said expansion chamber forming a closed space for a working fluid;

first and second compression rotors disposed within said compression chamber, said rotors forming at least one pair of compression spaces within said compression chamber;

first and second expansion rotors disposed within said expansion chamber, said rotors forming at least one pair of expansion spaces within said expansion chamber; and, a gear train disposed within said regenerator housing and comprising a plurality of non-round gears, a center gear group, first and second outer gear groups substantially opposed with respect to said center gear group, and a power shaft, wherein said gear train is connected to said first and second compression and expansion rotors, said gear train is arranged to oscillatingly rotate said first and second compression rotors and said first and second expansion rotors to create cyclically varying volumes for said at least one pair of compression spaces and said at least one pair of expansion spaces, respectively, and to control said fluid communication between said compression and expansion chambers so that two thermodynamic cycles are completed by said engine for each rotation of said first and second compression and expansion rotors.

2. The thermodynamic cycle heat engine of claim 1 wherein said at least one pair of expansion spaces further comprise a third volume, and said first volume is greater than said third volume.

3. The thermodynamic cycle heat engine of claim 1 wherein said low pressure connection further comprises a first cross section having a first area and said high pressure connection further comprises a second cross section having a second area less than said first area.

4. The thermodynamic cycle heat engine of claim 1 wherein said low pressure connection and said high pressure connection share at least one wall.

5. The thermodynamic cycle heat engine of claim 1 wherein said compression chamber further comprises a compression plate mounted to said first end and a compression cap having a first exterior surface, said compression cap mounted to said compression plate to form a compression chamber volume, said compression rotors are disposed within said compression chamber volume, and said first exterior surface is arranged for exposure to a cooling medium; and, wherein said expansion chamber further comprises an expansion plate mounted to said second end and an expansion cap having a second exterior surface, said expansion cap mounted to said expansion plate to form an expansion chamber volume, said expansion rotors are disposed within said expansion chamber volume, and said second exterior surface is arranged for exposure to a heating medium.

6. The thermodynamic cycle heat engine of claim 5 wherein said compression plate further comprises first and second ports in fluid communication with said low pressure connection for said first and second bi-directional regenerators, respectively, and third and fourth ports in fluid communication with said high pressure connection for said first and second bi-directional regenerators, respectively:

wherein said expansion plate further comprises fifth and sixth ports in fluid communication with said low pressure connection for said first and second bi-directional regenerators, respectively, and seventh and eighth ports in fluid communication with said high pressure connection for said first and second bi-directional regenerators, respectively; and, wherein said compression rotors are arranged to cyclically block said first, second, third, and fourth ports and said expansion rotors are arranged to cyclically block said fifth, sixth, seventh, and eighth ports as said compression and expansion rotors rotate.

7. The thermodynamic cycle heat engine of claim 6 wherein each said first and second compression rotors comprises at least one compression lobe, each said first and second expansion rotors comprises at least one expansion lobe, and said at least one pair of compression spaces further comprises a fourth volume; and, wherein said gear train is arranged to move said at least one lobe for said first and second compression rotors in respective opposing directions to increase and decrease said fourth volume and to move said at least one lobe for said first and second expansion rotors in respective opposing directions to increase and decrease said third volume.

8. The thermodynamic cycle beat engine of claim 7 wherein said at least one compression lobe further comprises first and second compression lobes and said at least one expansion lobe further comprises first and second expansion lobes, said first and second compression lobes are interleaved to form two pairs of compression spaces, and said first and second expansion lobes are interleaved to form two pairs of expansion spaces.

9. The thermodynamic cycle heat engine of claim 1 wherein said gear train further comprises first and second rotor round gears connected to said first and second compression rotors, respectively, and third and fourth rotor round gears connected to said first and second expansion rotors, respectively;

wherein said center gear group comprises first and second center elliptical gears mounted to a center shaft;

wherein said first outer gear group is mounted to at least one first outboard gear shaft and comprises first and second pairs of gears, said first and second pairs each comprising a first and second outboard elliptical gear, respectively, said first pair engaging said first rotor round gear and said center gear group and said second pair engaging said third rotor round gear and said center gear group; and, wherein said second outer gear group is mounted to at least one second outboard gear shaft and comprises third and fourth pairs of gears, said third and fourth pairs each comprising a third and fourth outboard elliptical gear, respectively, said third pair engaging said second rotor round gear and said center gear group and said fourth pair engaging said fourth rotor round gear and said center gear group.

10. The thermodynamic cycle heat engine of claim 9 wherein said first pair of gears includes a first round outboard gear engaged said with first rotor round gear and said first outboard elliptical gear is engaged with said first center elliptical gear, said second pair of gears includes a second round outboard gear engaged with said third rotor round gear and said second outboard elliptical gear is engaged with said second center elliptical gear, said third pair of gears includes a third round outboard gear engaged with said second rotor round gear and said third outboard elliptical gear is engaged with said first center elliptical gear, and said fourth pair of gears includes a fourth round outboard gear engaged with said fourth rotor round gear and said fourth outboard elliptical gear is engaged with said second center elliptical gear.

11. The thermodynamic cycle heat engine of claim 10 wherein said first and second center elliptical gears and said first, second, third, and fourth outboard elliptical gears have a one-to-one ratio with respect to each other and each said first, second, third, and fourth rotor round gears has a one-to-two ratio with respect to said first, second, third, and fourth outboard round gears.

12. The thermodynamic cycle heat engine of claim 11 wherein said first outboard gear group comprises an idler gear, said center gear group comprises a center round gear engaged with said idler gear, and said power shaft is engaged with said idler gear.

13. The thermodynamic cycle heat engine of claim 11 wherein said center gear group is mounted to said power shaft.

14. A thermodynamic cycle heat engine comprising:

first and second bi-directional regenerators, each said first and second bi-directional regenerator comprising a low pressure connection having a first volume and a high pressure connection having a second volume less than said first volume;

a compression chamber comprising first and second rotors, said rotors defining two pairs of compression spaces;

an expansion chamber comprising third and fourth rotors, said rotors defining two pairs of expansion spaces; and, a gear train comprising a center gear group, first and second outer gear groups substantially opposed with respect to said center gear group, and a power shaft, wherein each said center group and first and second outer groups includes at least one elliptical gear, said gear train is arranged to oscillatingly rotate said first and second compression rotors to create cyclically varying volumes for said two pairs of compression spaces, to oscillatingly rotate said first and second expansion rotors to create cyclically varying volumes for said two pairs of expansion spaces, and to control fluid communication between said compression and expansion chambers so that two thermodynamic cycles are completed by said engine for each rotation of said first and second compression and expansion rotors.

15. A method for completing a thermodynamic cycle in a heat engine, the method comprising:

oscillatingly rotating at least two compression rotor lobes disposed within a compression chamber using a gear train including a plurality of non-round gears, a center gear group, and first and second outer gear groups substantially opposed with respect to said center gear group;

forming at least one pair of compression spaces having cyclically varying volumes within said compression chamber;

oscillatingly rotating at least two expansion rotor lobes disposed within an expansion chamber using said gear train;

forming at least one pair of expansion spaces having cyclically varying volumes within said expansion chamber;

passing working fluid from said compression chamber through respective high pressure connections in first and second bi-directional regenerators to said expansion chamber, each said high pressure connection having a first volume;

passing said working fluid from said expansion chamber through respective low pressure connections in said first and second bi-directional regenerators to said compression chamber, each said low pressure connection having a second volume greater than said first volume; and, completing two thermodynamic cycles in said engine for each rotation of said at least two compression and expansion rotor lobes.

16. The method recited in claim 15 wherein said at least one pair of compression spaces further comprises two pairs of compression spaces and said at least two compression rotor lobes further comprises four compression rotor lobes; and, wherein said at least one pair of expansion spaces further comprises two pairs of expansion spaces and said at least two expansion rotor lobes further comprises four expansion rotor lobes.

17. The method recited in claim 15 wherein said at least one pair of compression spaces further comprises a third volume, and said second volume is greater than said third volume.

18. The method recited in claim 15 wherein said at least one pair of compression and expansion spaces further comprises fourth and fifth volumes, respectively; and, said method further comprising:

moving said at least two compression rotor lobes in opposing directions to increase and decrease said fourth volume and moving said at least two expansion rotor lobes in opposing directions to increase and decrease said fifth volume, wherein said moving is performed by said gear train.

19. The method recited in claim 15 wherein said gear train further comprises first and second rotor round gears each connected to one of said at least two compression rotor lobes and third and fourth rotor round gears each connected to one of said at least two expansion rotors;

wherein said center gear group comprises first and second center elliptical gears mounted to a center shaft;

wherein said first outer gear group is mounted to at least one first outboard gear shaft and comprises first and second pairs of gears, said first and second pairs each comprising a first and second outboard elliptical gear, respectively, said first pair engaging said first rotor round gear and said center gear group and said second pair engaging said third rotor round gear and said center gear group; and, wherein said second outer gear group is mounted to at least one second outboard gear shaft and comprises third and fourth pairs of gears, said third and fourth pairs each comprising a third and fourth outboard elliptical gear, respectively, said third pair engaging said second rotor round gear and said center gear group and said fourth pair engaging said fourth rotor round gear and said center gear group.

20. The method recited in claim 19 wherein said first pair of gears includes a first round outboard gear engaged said with first rotor round gear and said first outboard elliptical gear is engaged with said first center elliptical gear, said second pair of gears includes a second round outboard gear engaged with said third rotor round gear and said second outboard elliptical gear is engaged with said second center elliptical gear, said third pair of gears includes a third round outboard gear engaged with said second rotor round gear and said third outboard elliptical gear is engaged with said first center elliptical gear, and said fourth pair of gears includes a fourth round outboard gear engaged with said fourth rotor round gear and said fourth outboard elliptical gear is engaged with said second center elliptical gear.

21. The method recited in claim 20 wherein said first and second center elliptical gears and said first, second, third, and fourth outboard elliptical gears have a one-to-one ratio with respect to each other and each said first, second, third, and fourth rotor round gears has a one-to-two ratio with respect to said first, second, third, and fourth outboard round gears.

22. The method recited in claim 20 wherein said first outboard gear group comprises an idler gear, said center gear group comprises a center round gear engaged with said idler gear, and said power shaft is engaged with said idler gear.

23. The method recited in claim 20 wherein said center gear group is mounted to said power shaft.

* * * * *